US006102688A

United States Patent [19]

Mifune et al.

[11] Patent Number: 6,102,688

[45] Date of Patent: Aug. 15, 2000

[54] COMBUSTION APPARATUS FOR LIQUID FUEL AND COMBUSTION WICK

[75] Inventors: Hideo Mifune; Yasuaki Nakamura; Takashi Tsukamoto, all of Shizuoka-ken, Japan

[73] Assignee: Tokai Corporation, Tokyo, Japan

[21] Appl. No.: 09/171,470

[22] PCT Filed: Feb. 17, 1998

[86] PCT No.: PCT/JP98/00632

§ 371 Date: Feb. 16, 1999

§ 102(e) Date: Feb. 16, 1999

[87] PCT Pub. No.: WO98/37366

PCT Pub. Date: Aug. 27, 1998

[30] Foreign Application Priority Data

Feb. 20, 1997 [JP] Japan ..... 9-036064
Feb. 20, 1997 [JP] Japan ..... 9-036065

[51] Int. Cl.[7] ..... F23Q 25/00

[52] U.S. Cl. ..... 431/152; 431/298; 431/277

[58] Field of Search ..... 431/152, 298, 431/320, 149, 276, 277

[56] References Cited

U.S. PATENT DOCUMENTS

| | | | |
|---|---|---|---|
| 2,539,653 | 1/1951 | Back | 431/152 |
| 2,680,962 | 6/1954 | Lipic et al. | 431/152 |
| 4,035,138 | 7/1977 | Walters | 431/320 |
| 5,211,553 | 5/1993 | Menter | 431/298 |
| 5,425,633 | 6/1995 | Cole | 431/298 |

*Primary Examiner*—Carroll Dority
*Attorney, Agent, or Firm*—Baker & Botts, L.L.P.

[57] ABSTRACT

As regards size reduction of a burner that draws up liquid fuel to be burned utilizing capillarity, a wick and an igniter are brought into proximity without causing contact with the flame, either a flame-producing section (61) of the wick (6) being constituted in a tapered shape at the tip portion or the tip portion of a wick holder (77) being formed to differ in height in the circumferential direction.

14 Claims, 18 Drawing Sheets

COMBUSTION APPARATUS FOR LIQUID FUEL AND COMBUSTION WICK

TECHNICAL FIELD

This invention relates to a wick that draws up to be burned a liquid fuel in a lighter or other liquid fuel burner using an alcohol fuel or the like and to a liquid fuel burner equipped with the wick.

In particular, this invention relates to a wick and a wick peripheral structure for obtaining a desired burning state in a burner (e.g., a cigarette lighter, torch, lantern or other such fire-lighting device, lamp or the like) using a liquid fuel such as an alcohol, a benzene hydrocarbon or a petroleum hydrocarbon.

BACKGROUND TECHNOLOGY

An alcohol fuel such as ethyl alcohol, a benzene fuel of the petroleum benzene type or a liquid gas fuel such as butane gas or propane gas is generally used as the fuel of a cigarette lighter, fire-lighting device, torch, lamp or other such burner.

The performance, ease of use, and structural design of such burners differs depending on the kind of fuel used, and each has its own characteristics. In the case of a liquid gas fuel, for instance, the gas pressure is high in the use temperature range of the burner and the vessel storing the fuel has to have a pressure-resistant structure. Moreover, the flame length changes with variation in the gas pressure and since it is a characteristic of the gas pressure to vary logarithmically and greatly with temperature, large change in flame length with temperature becomes a particular problem. In order to reduce this flame-length variation, the fuel supply mechanism of the burner requires a special design countermeasure for affecting temperature compensation, which complicates the structure and is disadvantageous from the aspect of cost.

In contrast, since a liquid fuel such as an alcohol fuel is a liquid at ordinary temperatures and is also relatively low in vapor pressure, it does not require a pressure-resistant vessel in the fuel storage section and, as such, simplifies the structure of the burner and is advantageous from the aspect of cost. Further, in the liquid fuel burner, the means used to supply the liquid fuel from the fuel storage section to the flame-producing section is generally a wick that utilizes the surface tension of the liquid fuel to draw it up through continuous fine holes or fine voids among bundled fibers by capillarity and burns it at the tip portion thereof.

Specifically, the wick used for drawing up the fuel is a string-like one obtained by twisting fibers, one obtained by bundling fibers, one using both of these with the glass fibers enclosed in cotton yarn and the result interwoven with fine metal wires to prevent disintegration, or the like, whose the lower end portion functions to draw up fuel to be burned at the upper end tip portion.

The flame-producing section of the wick has to be sealed by an openable/closeable closure cap in order to prevent evaporation of the liquid fuel during nonuse. In addition, a striker wheel or other igniter must be installed near the wick for scattering sparks to light the wick.

Since the closure cap is ordinarily installed to open and close about a pivot at one end portion thereof, its cap portion for sealing the flame-producing section of the wick passes along an arcuate path and, therefore, when it is attempted to make such a lighter or other burner compact, the need to prevent interference of this path with the wick tip portion, the wick holder, the striker wheel etc. hinders the size reduction.

Particularly, as regards sealing of the portion of the wick holder of the wick, the sealing end portion of the closure cap must interpose between the wick holder portion and the igniter, e.g., striker wheel, in order to enable covering of the peripheral portion of the wick holder portion, and if the igniter is spaced away from the wick in order to avoid interference of the sealing end portion with the igniter, a problem of igniting performance degradation may arise because of, for example, the elongated spark travel distance. Good igniting performance is therefore preferably secured by disposing the igniter near the wick.

On the other hand, when the igniter is installed closer to the wick, the flow of air around the flame changes to impede inflow of secondary air to the flame in proportion as the igniter is disposed nearer the flame and the flame tends to swell toward the igniter side so that its edge portion comes near or in contact therewith. The temperature of the igniter (e.g., striker wheel) is therefore liable to rise. When the striker wheel is heated, the heat may, for example, be conducted to its plastic support portion to melt the support portion. The striker wheel may then be detached by the pressing force of the flint urged against the striker wheel, making it useless.

In addition, when a wick made by merely bundling glass fibers or other fiber material is used and the glass fiber bundle at the tip portion of the wick are undone and spread out by contact of the end portion of the closure cap with the wick tip or contact of the object to be lit (e.g., cigarette) with the wick tip, the flame thickens, as shown in FIG. 8 to be explained later, to possibly approach the igniter (e.g., striker wheel) and, at the same time, the sealing portion of the closure cap is liable to catch a portion of the frayed wick tip and be degraded in evaporation preventing performance.

In consideration of the foregoing circumstances, this invention aims to provide a wick for a liquid fuel burner that by changing the shape of the flame-producing section enables the igniter to be located near the wick while avoiding interference with the closure cap.

The invention further aims to provide a liquid fuel burner which by changing the shape of the wick holder enables the igniter to be disposed at a position near the wick to ensure good igniting performance, while avoiding interference with the closure cap, and also avoids elevated temperature states by preventing swelling of the flame toward the igniter side.

DISCLOSURE OF THE INVENTION

The invention liquid fuel burner wick, which overcomes the problems set out in the foregoing, is characterized in that, as regards drawing up by the capillarity of a draw-up section liquid fuel to be burned at a flame-producing section, the flame-producing section is constituted in a shape to have a tapered tip portion.

Where the closure cap is constituted to open and close about a pivot at one end portion thereof, the tip portion of the flame-producing section on the side opposite from the pivot of the closure cap is removed to provide a tapered tip portion.

Where the flame-producing section is composed of glass fibers, its tip portion is preferably fusion-bonded into a pointed shape like the tip of a writing brush. This wick can be shaped by bundling glass fibers, heating and fusing a portion thereof with a high-temperature burner and drawing out and separating the fused portion.

On the other hand, the wick can be one with a flame-producing section composed of a porous glass material having continuous bubbles or a sintered porous ceramic material and constituted in a tapered shape.

The wick can be one whose flame-producing section and draw-up section are formed of different materials or otherwise be one whose flame-producing section and draw-up section are integrally formed of the same material.

As the liquid fuel there can be used an alcohol fuel, for example, one having a lower monovalent alcohol, namely, methyl alcohol, ethyl alcohol or propyl alcohol, as its main component and having mixed therewith a saturated hydrocarbon such as hexane or heptane for coloring the flame, or, otherwise, a benzene hydrocarbon or a petroleum hydrocarbon or the like.

According to the aforesaid wick, since interference with the closure cap is avoided by the formation of the tip portion of the flame-producing section in a tapered shape, the spacing at which the closure cap and the wick are installed can be reduced, the spacing at which the wick and the igniter are installed can also be reduced and, moreover, the closure cap can be formed smaller, whereby design freedom increases and it becomes possible to realize a smaller burner, lower cost and other advantages.

Where the tip portion of a flame-producing section made of glass fibers is fusion-bonded or where a flame-producing section composed of a porous glass material or porous ceramic material is given a tapered shape, the tip portion of the wick does not fray or experience other deformation even if a cap portion contacts the wick tip portion when the closure cap for preventing evaporation is placed over the wick or if a cigarette or other object to be lit contacts it. Since the shape of the wick therefore does not change even with repeated use over a long time period, a flame of stable shape can be maintained, temperature rise of components near the flame can be preclude since the flame does not approach or contact them, and a good sealed state of the closure cap can be secured with no wick portion being caught in the gap thereof during opening and closing. Particularly where the flame-producing section of the wick is formed by heating and fusing bundled glass fibers and drawing out the fused portion, it can be easily fusion-bonded and provided in a good shape.

The liquid fuel burner of the invention comprises a wick for drawing up by the capillarity of a draw-up section liquid fuel to be burned at a flame-producing section, an igniter for igniting the flame-producing section of the wick and a closure cap for preventing evaporation capable of sealing the flame-producing section of the wick openably and closably and is characterized in that a wick holder for holding the wick is provided around the flame-producing section at a tip of the wick and a tip portion of the wick holder is formed to differ in height in a circumferential direction, a tip portion of high height being disposed to be interposed between the flame-producing section of the wick and the igniter.

Preferably the closure cap is constituted to open and close about a pivot at one end portion thereof and an edge portion of a sealing portion thereof for sealing the flame-producing section of the wick is formed to differ in height in a circumferential direction complementarily to the shape of the tip portion of the wick holder.

As the wick held in the wick holder of the aforesaid type there can be used one whose flame-producing section and drawup section are formed of different materials or, otherwise, one whose flame-producing section and draw-up section are integrally formed of the same material.

The structure for forming the tip portion of the wick holder to differ in height in the circumferential direction can, as in embodiments explained later, be one where the tip of the wick holder is formed with an inclined surface or otherwise can be one where the tip portion of the wick holder is formed steplike.

According to the aforesaid burner, since the tip portion of the wick holder for holding the wick is formed to differ in height in the circumferential direction and a portion of high height is disposed to be interposed between the wick and the igniter, the center position of the flame during burning by the wick held by this wick holder is displaced from the center of the wick in the direction of moving away to the opposite side from the igniter, thereby enabling the igniter (e.g., striker wheel) to be disposed near the wick. Moreover, since the aforesaid configuration of the wick holder enables the closure cap to be formed smaller, the igniter can be installed nearer the wick to ensure good igniting performance while avoiding interference with the closure cap and preventing temperature increase, and, further enhancing design freedom and realizing size and cost reduction.

Where the shape of the tip portion of the sealing portion of the closure cap is formed to differ in height in the circumferential direction complementarily to the shape of the tip portion of the wick holder, the inner diameter, height and other dimensions of the tight sealing structure for preventing evaporation from the wick can be made smaller, which contributes to size reduction because the path of the opening/closing operation becomes short and the igniter can be closely disposed.

Where the wick held by the wick holder of the foregoing type is of a shape removed of the tip portion of the flame-producing section on the side opposite the pivot in open/close operation of the closure cap, e.g, where the tip portion of a wick made of glass fibers is fusion-bonded into a pointed shape like the tip of a writing brush or where it is formed by sintering, interference with the opening/closing of the closure cap is further avoided and the closure cap can be made small.

BRIEF DESCRIPTION OF DRAWINGS

FIGS. 5(A)–5(F) show sectional views of the essential portions of examples of structures for wick sealing by the closure cap according a fifth embodiment of the invention.

FIG. 18 shows a metal plate placed near a wick of a conventional comparative lighter.

BEST MODE FOR CARRYING OUT THE INVENTION

Embodiments of the liquid fuel burner and the wick thereof according to the invention will be explained in the following with reference to the drawings.

<First Embodiment>

Figure 1:
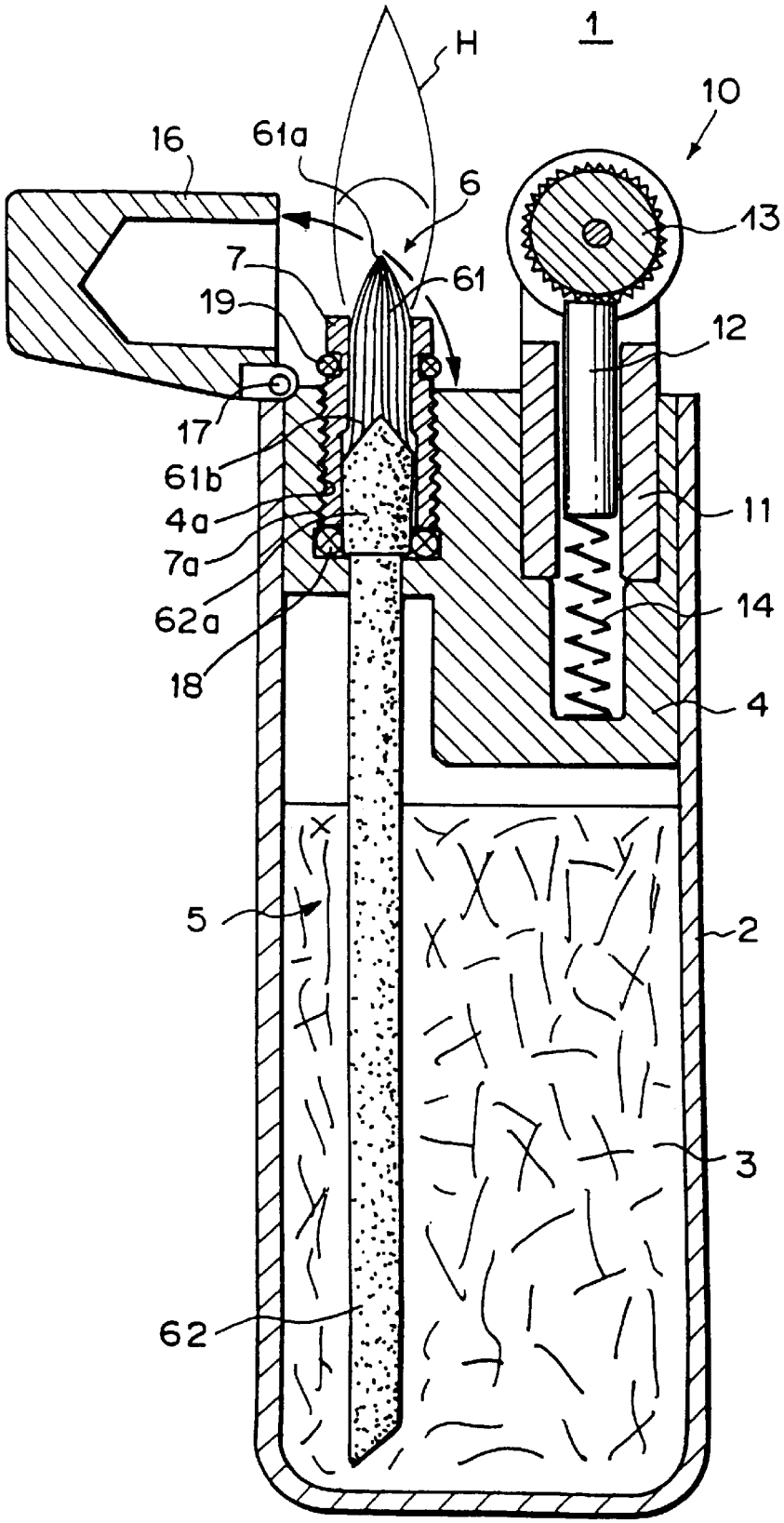
FIG. 1 is a schematic sectional view of a lighter as an example of a liquid fuel burner incorporating a wick that is a first embodiment of the invention.

FIG. 1 shows the general sectional structure of a lighter as an example of a liquid fuel burner incorporating a wick according to this embodiment of the invention.

A wick 6 is formed separately of different materials at an upper flame-producing section 61 and a lower draw-up section 62 and the two are joined by a wick holder 7 with the lower end portion of the flame-producing section 61 and the upper end portion of the draw-up section 62 in a contacted state.

The flame-producing section 61 is made from glass fibers by, for example, bundling the glass fibers and fusion-bonding the tip portion 61*a* to form it into a pointed shape like the tip of a writing brush.

Figure 7:
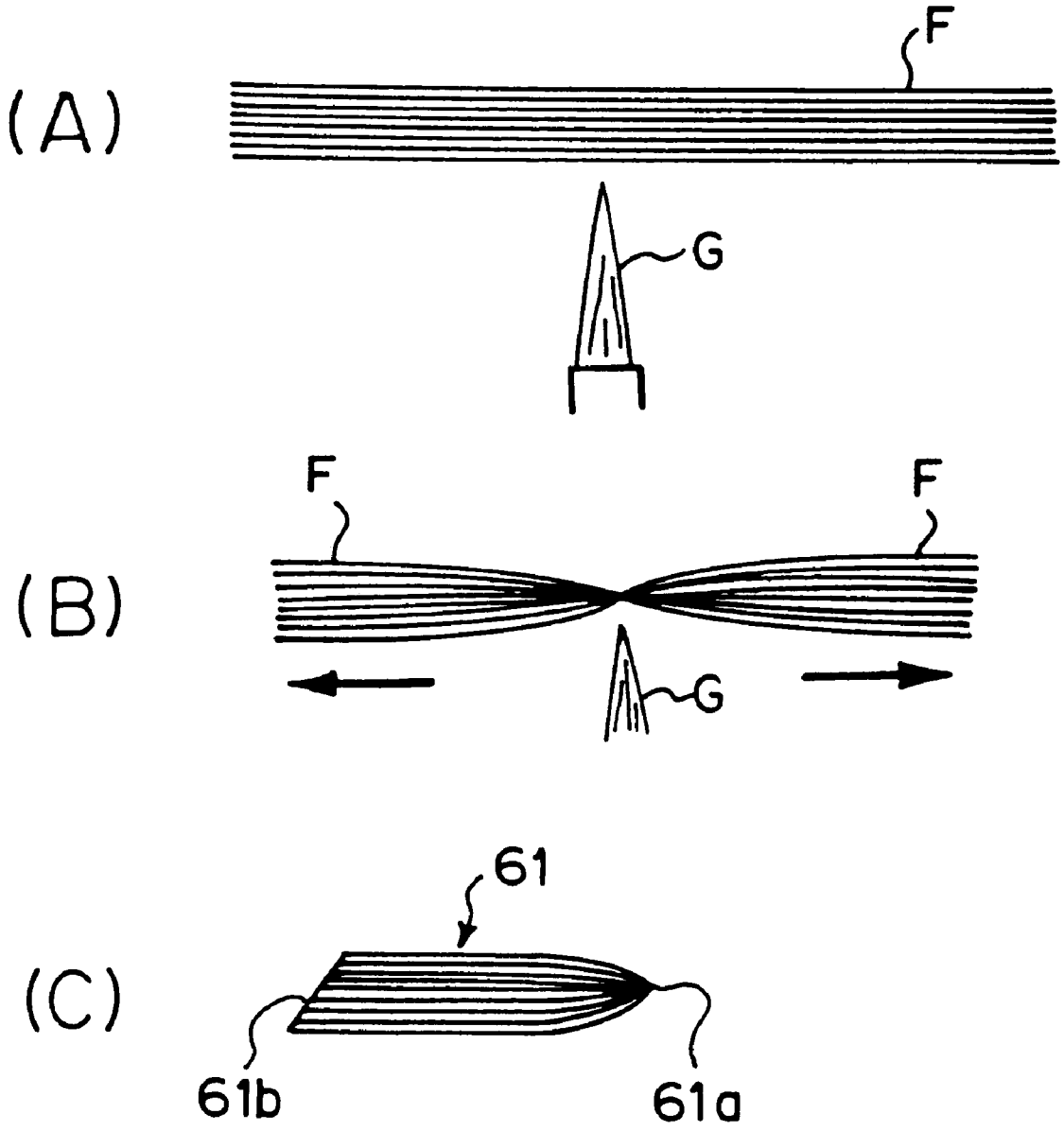
FIGS. 7(A)–7(C) views for explaining a step of fusion-bonding the tip portion of the wick made of glass fibers in the first embodiment.

In the formation, as illustrated in FIG. 7, glass fiber filaments F are cylindrically bundled to the required diameter like a string and the middle portion of the fiber bundle is heated with a high-temperature burner G, as shown in (A). Then, as shown in (B), the opposite ends of the glass fiber bundle are drawn outward as the heated portion of the glass fiber filaments F is melted. By this the molten portion of the glass fibers fuse and bind together and the tip portions are drawn to form a point like the tip of a writing brush. Further, as shown in (C), a base 61*b* is cut, obliquely for example, at a prescribed length, thereby fabricating the flame-producing section 61 of the wick 6 so as to have the bonded tip portion 61*a*.

The base portion of this flame-producing section 61 is inserted and fixed in the cylindrical wick holder 7 made of metal. The draw-up section 62, formed as a rod having a large-diameter head portion 62*a* by molding and sintering polyethylene powder, is inserted leg portion first into a fuel tank 2 through a mounting hole in a top cover 4, the lower end of the head portion 62*a* of the draw-up section 62 is held by a retaining portion at the lower end of the hole of the top cover 4, and a fastening thread 7*a* on the outer periphery of the wick holder 7 is screwed into a threaded hole 4*a* from above to sandwich an O-ring 18, thereby attaching the flame-producing section 61 to the top cover 4 while joining it with the draw-up section 62.

The amount of fuel consumed by the wick 6 when lit, the flame shape and the flame length are determined by the thickness, number and length of the glass fibers of the flame-producing section 61. In contrast, the formation pattern of the gaps in the draw-up section 62, which determines the fuel draw-up and supply characteristics, differs with the thickness, the particle diameter of the sintered polyethylene, the sintered density and the like of the draw-up section 62. The head portion 62*a* of the draw-up section 62, being formed to a large diameter to have a large volume, constitutes a fuel reservoir for holding the liquid fuel. Burning stabilization is obtained by this fuel reservoir.

In the case of, for example, a cigarette lighter incorporating the wick 6, a flame-producing section 61 having a glass fiber thickness of 6 $\mu$m, a fiber density (metsuke amount) of 150 mg/cm$^3$, an outer diameter of 3 mm and a length of 10 mm is inserted into the wick holder 7 to protrude to a length of 3 mm from the tip portion of the wick holder 7. On the other hand, the draw-up section 62 is obtained by placing in a mold polyethylene powder that is a mixture of particles of 70–200 mesh with an average particle size of 140 mesh and sintering it for 10 minutes at 170° C. The head portion 62*a* is formed to an outer diameter of 4.2 mm and a length of 3 mm and the lower leg portion to an outer diameter of 4 mm and a length of 37 mm.

This wick 6 is incorporated into the lighter 1, as the burner, with the draw-up section 62 inserted into a fuel reservoir section 5 to draw up and supply liquid fuel to the flame-producing section 61 and effects burning at the tip portion 61*a* of the flame-producing section 61 upon being lit by an igniter 10. When continuous burning is effected uninterrupted, the flame of the burning at the flame-producing section 61 is maintained without changing in shape or length by establishing a characteristic whereby the amount of fuel supplied by the draw-up section 62 is equal to or greater than the amount of fuel consumption of the flame-producing section 61.

The structure of the lighter 1 will be explained next. The lighter 1 has the tank 2 of cylindrical shape with closed bottom. Fiber material 3 (stuffing) is inserted into the interior of the fuel tank 2 and the top cover 4 is fixed to the upper portion of the tank 2 to constitute the fuel reservoir section 5 for storing liquid fuel.

The tank 2 is, for example, provided as a shaped article made of polypropylene with an inner volume of 5 cm$^3$. The fiber material 3 is polypropylene fiber of a thickness of 1–2 denier compacted in the tank 2 to a density of 0.1 g/cm$^3$. 4 g of liquid fuel, a mixture of 95 wt % ethyl alcohol and 5 wt % n-hexane, is poured and impregnated into this fiber material 3 for storage therein.

The wick 6 is inserted to pass through the middle of the top cover 4 vertically into the tank 2 and the wick holder 7 portion is fixed to the top cover 4. The lower end portion of the draw-up section 62 of the wick 6 contacts the fiber material 3 in the tank 2 and draws up the liquid fuel impregnated in the fiber material 3 utilizing capillarity. The flame-producing section 61 of the wick 6 is lit to burn and generate a flame, and the amount of protrusion of the flame-producing section 61 from the wick holder 7 is adjusted to about 3 mm, as mentioned earlier, to obtain a flame length of 30 mm.

The igniter 10 is installed on the top cover 4 to face the tip of the flame-producing section 61 of the wick 6. A bracket 11 of the igniter 10 fixed to the top cover 4 has a flint 12 inserted therein to be vertically movable and a rotating striker wheel 13 is provided on the upper end of the bracket 11 as the proximate member nearest to the flame H. The tip of the flint 12 is pressed onto the peripheral surface of the rotating striker wheel 13 by the energizing force of a flint pusher spring 14 and rotation of the rotating striker wheel 13 causes sparks to fly toward the wick 6.

A closure cap 16 for evaporation prevention is provided to openably/closably cover the flame-producing section 61 of the wick 6 together with the protruding portion of the wick holder 7. This closure cap 16 is rotatably pivoted by a pin 17 at one end portion of the upper surface of the top cover 4 of the tank 2. An O-ring 19 is attached to the outer peripheral root portion of the wick holder 7 and the inner peripheral surface of the sealing portion of the closure cap 16 presses thereon to enhance the sealing property.

In the assembled state of the lighter 1, the upper end of the flame-producing section 61 of the wick 6 is 2.5 mm higher than the height of the contact point of the rotating striker wheel 13 and the flint 12, and the positional relationship is set so that the distance between the center of the wick 6 and the center of the rotating striker wheel 13 is 10 mm.

As regards the shape of the flame H during burning, under conditions set to make the flame length 30 mm, the flame width is 9 mm and the position of greatest flame width is 3 mm from the lower end of the flame and this flame H burns without touching the rotating striker wheel 13 that is the igniter 10.

In the lighter 1 of the foregoing embodiment, the fact that the tip portion 61*a* of the flame-producing section 61 of the wick 6 is formed to be thin shortens the turning radius of the arc of the closure cap 16 relative the support point 17 (pin) that does not bring it into contact with the tip of the wick 6 or the wick holder 7. Accordingly, the distance between the pivot point of the closure cap 16 and the wick 6 can be reduced and, more over sealine the inner diameter of the sealing portion of the closure cap 16 need not be expanded greatly relative to the outer diameter of the wick holder 7, the closure cap 16 and the lighter 1 can be made small in size.

In other words, the pivot position of the closure cap 16 has to be set so that during opening/closing operation thereof the inner surface of the closure cap 16 does not hit the tip of the wick 6 or the tip of the wick holder 7. If the wick tip portion 61*a* is not made thin, e.g., in a lighter using a wick made of glass fibers in a unbonded state, the distance between the pivot of the closure cap 16 and the center of the wick 6 has to be set relatively long to establish a large turning radius, making the closure cap 16 and the overall structure of the lighter large (see FIG. 8). If it is only desired to make the distance between the pivot and the wick 6 short, this is possible by making the inner diameter of the sealing portion of the closure cap 16 large but the closure cap 16 then comes to rotate at a position apart from the outer diameter of the wick holder 7 so that the distance between the wick 6 and the rotating striker wheel 13 must be made long to avoid interference with the rotating striker wheel 13. The invention, however, enables size reduction on these points.

<Second Embodiment>

Figure 2:
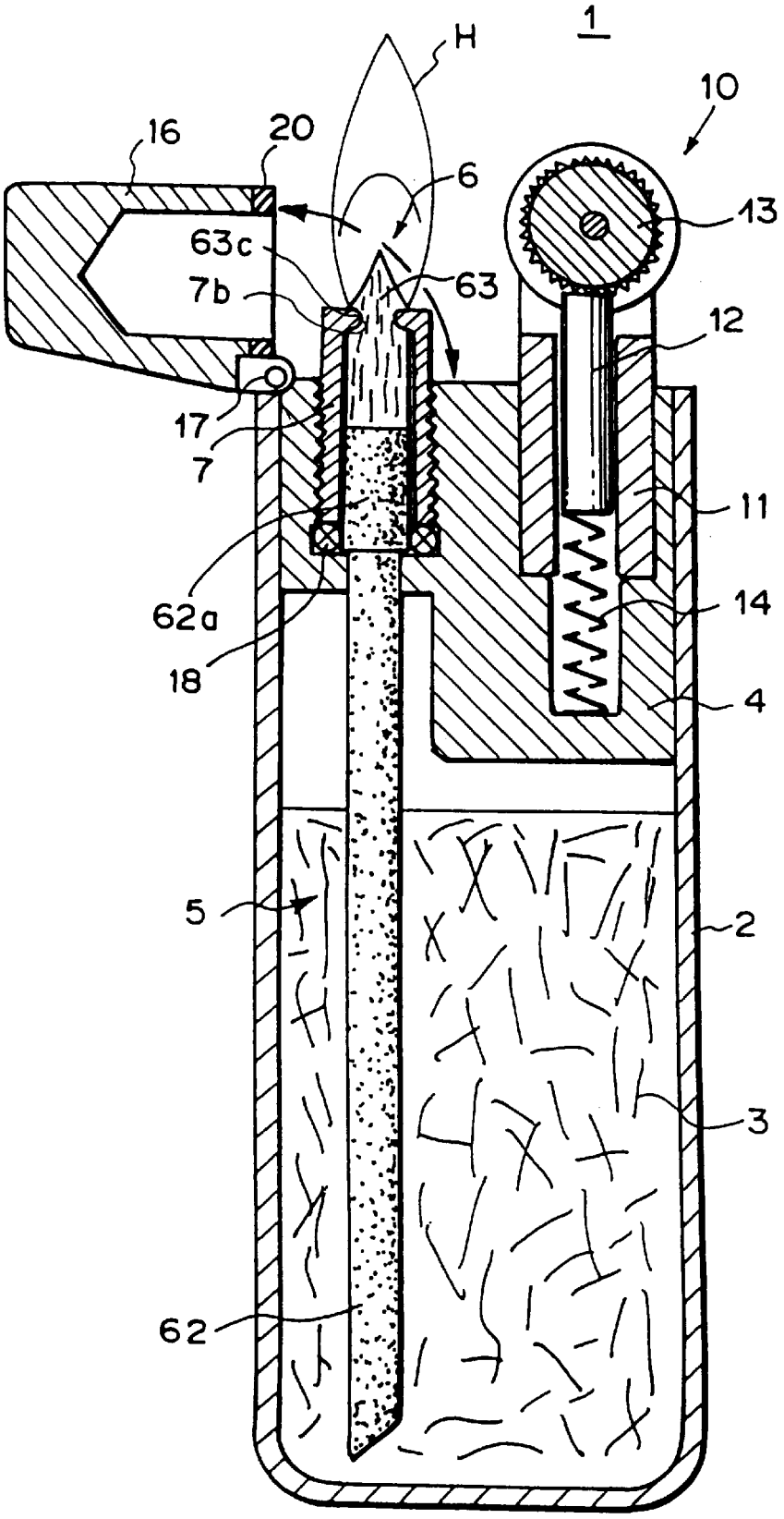
FIG. 2 is a schematic sectional view of a lighter as an example of a liquid fuel burner incorporating a wick that is a second embodiment of the invention.

As shown in FIG. 2, the wick 6 of the lighter 1 of this embodiment is formed of a different material from that of the first embodiment.

The flame-producing section 63 of the wick 6 of this embodiment is a porous ceramic sintered body formed in round rod-like shape, contains continuous bubbles (capillary passages) inside, and is formed thin at the tip portion. The upper portion of this flame-producing section 63 is mounted to protrude from the tip of the wick holder 7 by a prescribed amount (3 mm). This protrusion amount, the diameter and the like determine the size of the flame H. For instance, it is constituted to have an outer diameter of 3.0 mm and a length of 10 mm.

On the other hand, the draw-up section 62 whose tip portion abuts on the lower end portion of the flame-producing section 63 is again a porous material made of a sintered body of polyethylene powder and formed into round rod-like shape. An engagement groove 63*c* is provided in the upper outer periphery of the flame-producing section 63 and a projection 7*b* directed toward the center of the upper end portion of the wick holder 7 is engaged in and retained by the engagement groove 63*c*. The lower end portion of the flame-producing section 63 is unitarily joined with the upper end portion of the draw-up section 62 by screwing the flame-producing section 63 and the wick holder 7 into the top cover 4.

The closure cap 16 for sealing the wick 6 and the protruding portion of the wick holder 7 has a seal member 20 attached to the tip portion of its sealing portion. This seal member 20 is constituted so as to press onto the top cover 4 around the wick holder 7 and establish sealing at the time of the closing operation of the closure cap 16. The other portions are formed like those of the first embodiment. The same constituent components are assigned the same references symbols and explanation thereof is omitted.

<Third Embodiment>

Figure 3:
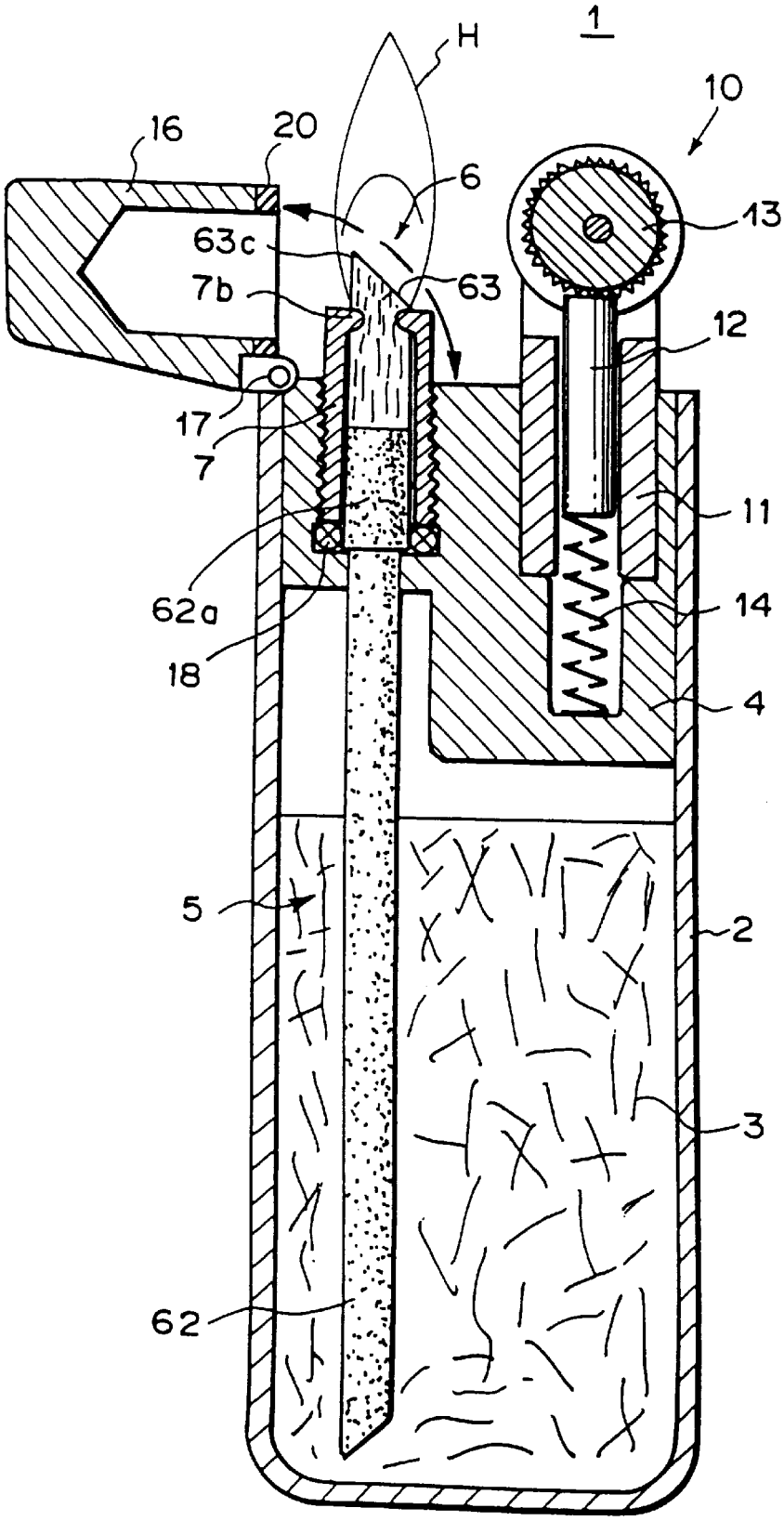
FIG. 3 is schematic sectional view of a lighter incorporating a wick that is a third embodiment of the invention.

As shown in FIG. 3, only the shape of the tip portion of the wick 6 of the lighter 1 of this embodiment differs from the second embodiment and other aspects are identically structured.

The flame-producing section 63 of the wick 6 is formed in a rod-like shape of a porous ceramic sintered body and its tip portion is removed slantedly (a curved surface is also acceptable) at the side portion opposite from the support pin 17 of the closure cap 16. By this, interference of the flame-producing section 63 with the opening/closing operation of the closure cap 16 is avoided to enable the two to be disposed in proximity.

<Fourth Embodiment>

Figure 4:
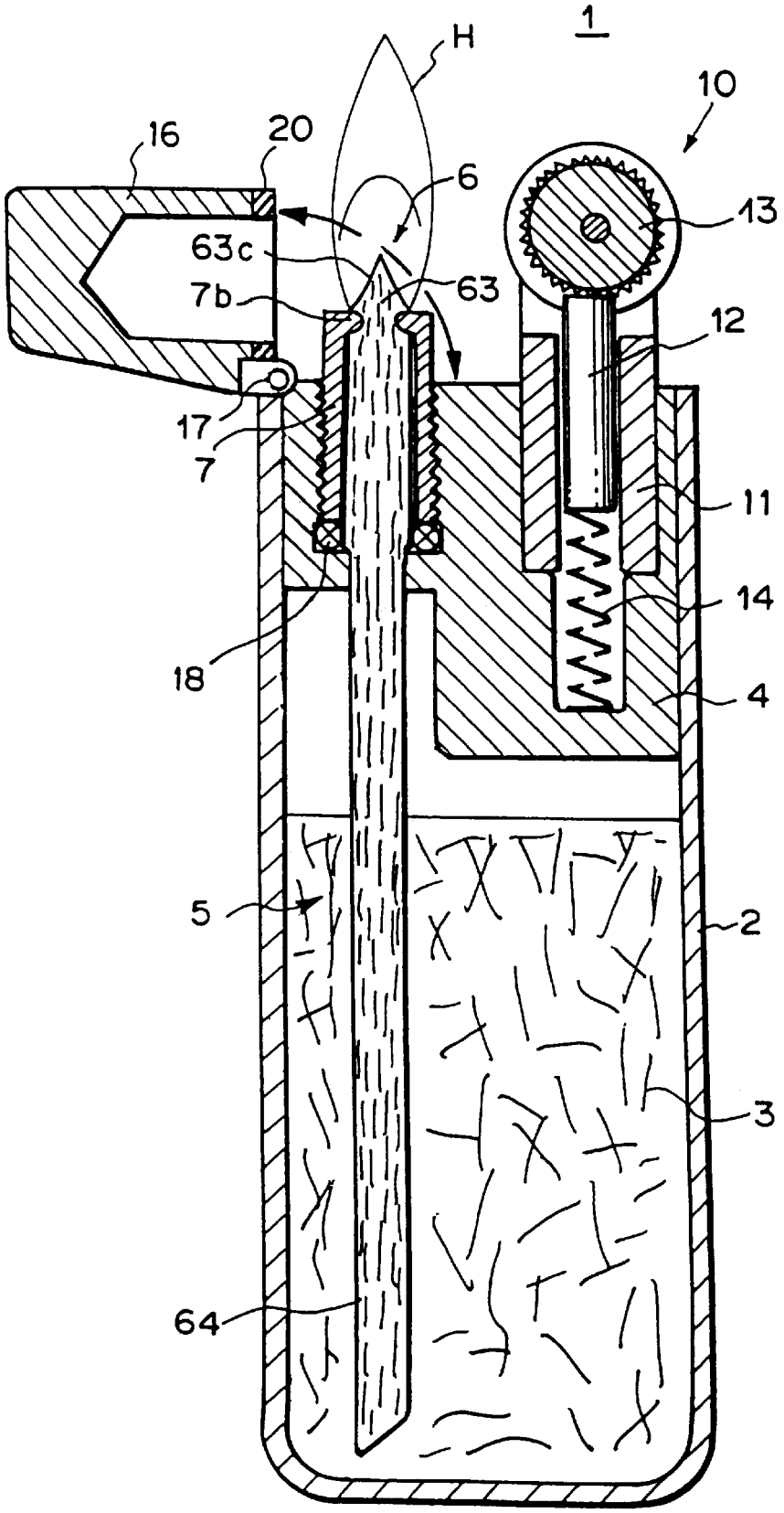
FIG. 4 is schematic sectional view of a lighter incorporating a wick that is a fourth embodiment of the invention.
Figure 5A:
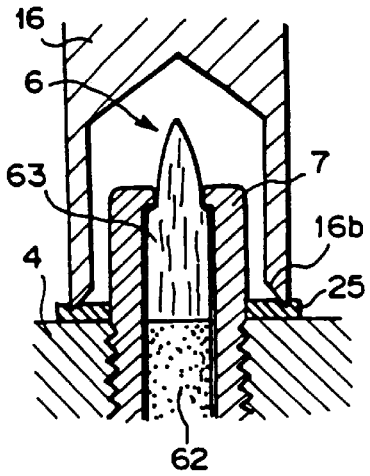
Figure 5B:
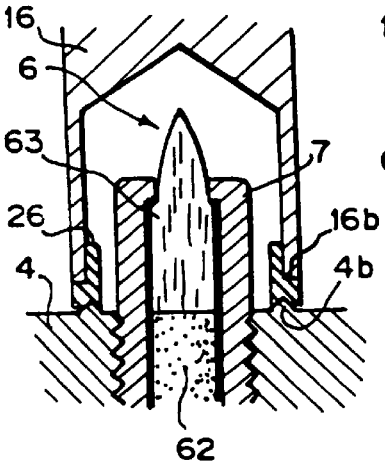
Figure 5C:
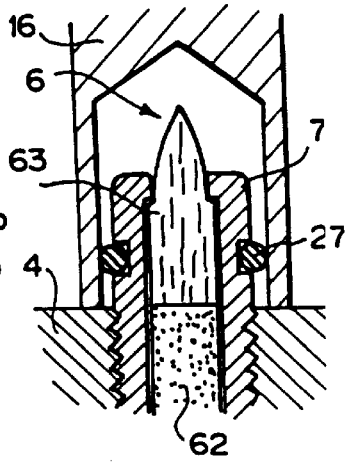
Figure 5D:
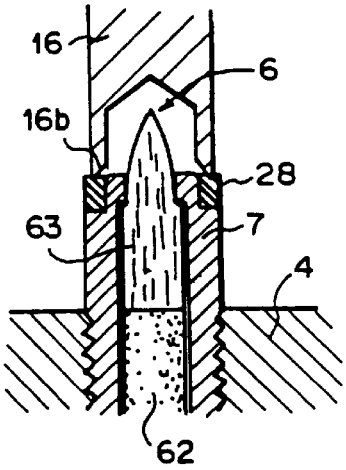
Figure 5E:
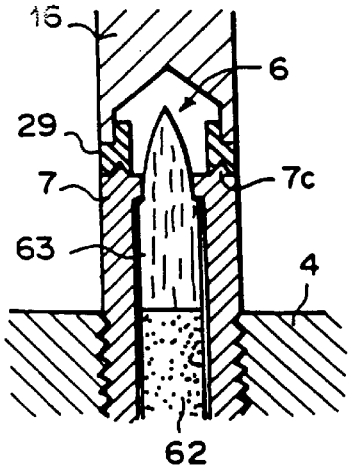
Figure 6A:
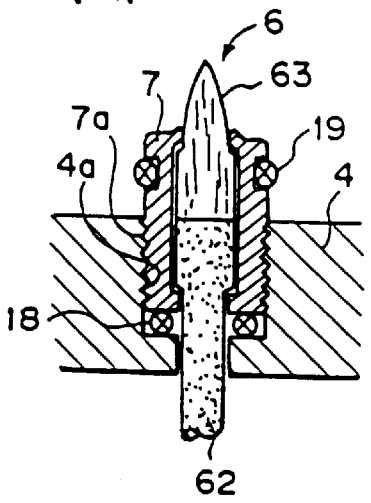
FIGS. 6(A)–6(F) show sectional views of the essential portions of examples of wick holding structures and structures for attachment of the wick to a top cover according a sixth embodiment of the invention.
Figure 6B:
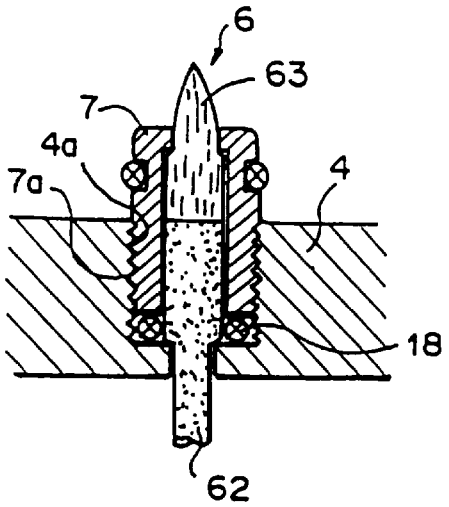
Figure 6C:
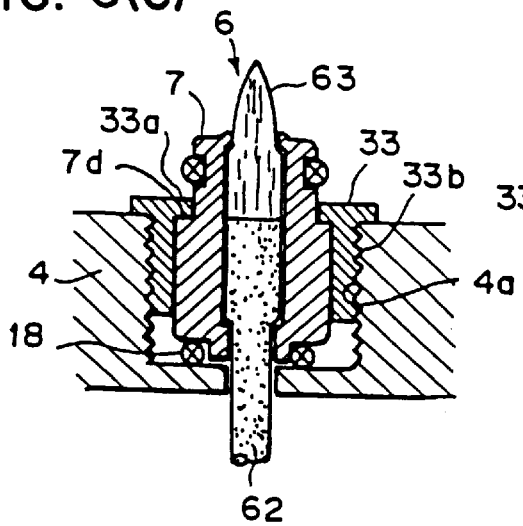
Figure 6D:
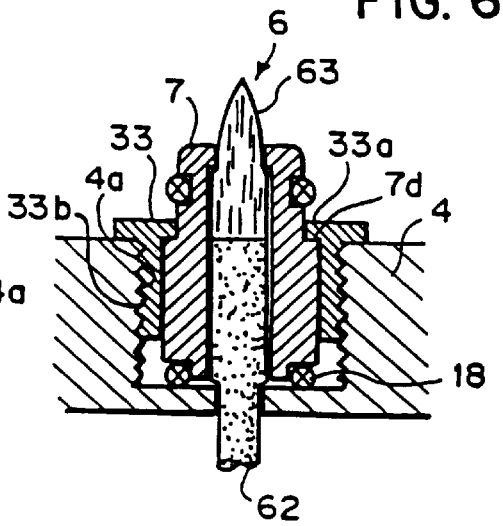
Figure 6E:
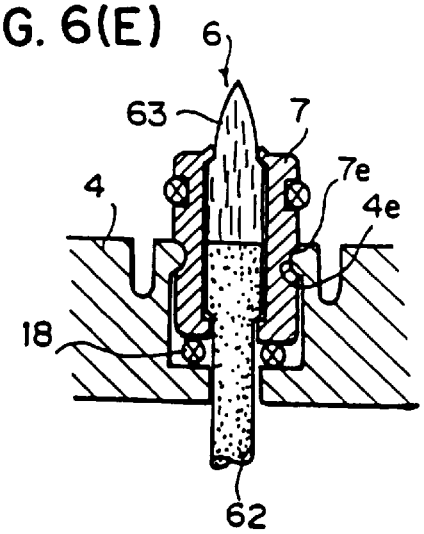
Figure 6F:
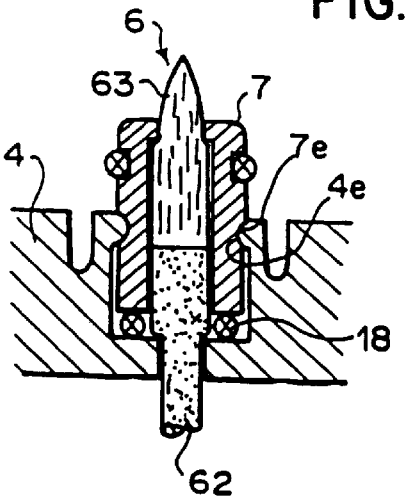

As shown in FIG. 4, the wick 6 of the lighter 1 of this embodiment is integrally formed throughout of the same material. Other aspects are structured like those of the second embodiment (FIG. 2).

The wick 6 has its flame-producing section 63 and draw-up section 64 formed integrally of a porous ceramic sintered body, is retained by the wick holder 7, and has the same shape as the one in FIG. 2.

<Fifth Embodiment>

FIGS. 5(A) to (E) show various examples of the seal structure of the flame-producing section of the wick 6 by the closure cap 16.

(A) is a structure wherein a seal member 25 is disposed on the upper surface of the top cover 4 around the wick holder 7 and seals by pressing the tip portion 16*b* of the closure cap 16 onto the seal member 25.

(B) is a structure wherein an annular projection 4*b* is provided on the upper surface of the top cover 4 around the wick holder 7 while a ring-like seal member 26 is attached to the sealing tip portion 16*b* of the closure cap 16, sealing being obtained by pressing the seal member 26 onto the annular projection 4*b*.

(C) is a seal structure similar to that in FIG. 1, wherein an O-ring 27 if fitted horizontally around the wick holder 7, sealing being obtained by pressing the inner surface of the closure cap 16 onto the O-ring 27.

(D) is a structure wherein an annular seal member 28 is provided around the tip of the wick holder 7, sealing being obtained by pressing the tip portion 16*b* of the closure cap 16 onto the annular seal member 28.

(E) is a structure wherein an annular projection 7*c* is provided on the tip surface of the wick holder 7 and a seal member 29 is attached to the sealing tip portion 16*b* of the closure cap 16, sealing being obtained by pressing the seal member 29 onto the annular projection 7*c*.

<Sixth Embodiment>

FIGS. 6(A) to (F) show various examples of the structure for joining or fastening the flame-producing section and the draw-up section of the wick 6 and of the structure for attaching the wick 6 to the top cover 4 of the fuel tank together with the wick holder 7.

(A) is a structure wherein the flame-producing section 63 and the head of the draw-up section 62 of the wick 6 are inserted into the wick holder 7 and then joined by caulking the lower end portion (or upper end portion) of the wick holder 7, and the wick holder 7 is attached by screwing the fastening thread 7*a* on the outer periphery thereof into the threaded hole 4*a* provided in the top cover 4 to sandwich the O-ring 18 at the bottom.

(B) is a structure similar to that indicated in the second embodiment (FIG. 2), wherein the lower end portion of the wick holder 7 is not caulked, the lower end of the head of the draw-up section 62 is fastened and held by the bottom portion of the threaded hole 4*a* of the top cover 4, and the wick holder 7 is attached to the top cover 4 by fastening it from above to sandwich the O-ring 18 while joining the flame-producing section 63 to the draw-up section 62.

(C) is a structure wherein the wick holder 7 is not formed with a fastening thread but is attached via an anchor ring 33 by engaging an upper engaging portion 33*a* of the anchor ring 33 with a step portion 7*d* of the wick holder 7 and screwing a fastening thread 33*b* on the outer periphery of the anchor ring 33 into the threaded hole 4*a* of the top cover 4, the fixing of the wick 6 with respect to the wick holder 7 being the same as in (A).

(D) combines a structure for attaching the wick holder 7 to the top cover 4 like that of (C) and a structure for fixing the wick 6 like that of (B).

(E) is a structure wherein a U-groove 7*e* is formed in the outer periphery of the wick holder 7, an engaging projection 4*e* imparted with elasticity is provided on the top cover 4, and attachment is achieved by forcing the bottom portion of the wick holder 7 into the top cover 4 to engage the tip of the engaging projection 4*e* with the U-groove 7*e*, the retention of the wick 6 being the same as in (A) above.

(F) combines a structure for attaching the wick holder 7 to the top cover 4 like that of (E) and a structure for fixing of the wick 6 like that of (B).

The liquid fuel poured into the fuel reservoir section 5 of the lighter 1 or other burner is, in the case of an alcohol fuel, preferably one using an alcohol that is a lower monovalent alcohol, namely, methyl alcohol, ethyl alcohol or propyl alcohol, as its main component and having added thereto one or more kinds of hydrocarbon compound having nearly the same boiling point as the main component, namely, hexane, heptane, octane, nonane, cyclohexadiene, cycloheptene or other saturated hydrocarbon. This is because the flame is colorless with only an alcohol fuel but the tip portion of the flame comes to be tinted lantern-yellow by the red heat of free carbon owing to the addition of the saturated hydrocarbon. A liquid fuel composed of at least one kind among heptane, octane and nonane can also be used. An liquid fuel of a benzene hydrocarbon is also acceptable.

On the other hand, liquid fuel burners other than cigarette lighters include torches, lanterns and other such fire-lighting devices and lamps.

<Test 1>

A test will be described in which a lighter 1 incorporating the wick 6 such as described above was used and the change in flame shape in repeated lighting and use was measured.

In this test there was used a lighter 1 wherein the wick 6 of the first embodiment (FIG. 1), whose tip portion 61*a* of the flame-producing section 61 was fusion-bonded, was retained in a wick holder 7 with a flat tip portion. As a comparative example, there was used a lighter wherein a wick 6 such as shown in FIG. 8, whose tip of the flame-producing section 60 was not fusion-bonded, was retained in a wick holder 7 with a flat tip portion.

The operations of opening the closure caps 16 of both lighters, operating the rotating striker wheels 13 to light the wicks 6, allowing the burning to continue for a prescribed time period and then closing the closure caps 16 to seal the wicks 6 and extinguish the flames were repeated, and the change in the shape of the flames H was observed.

Figure 8:
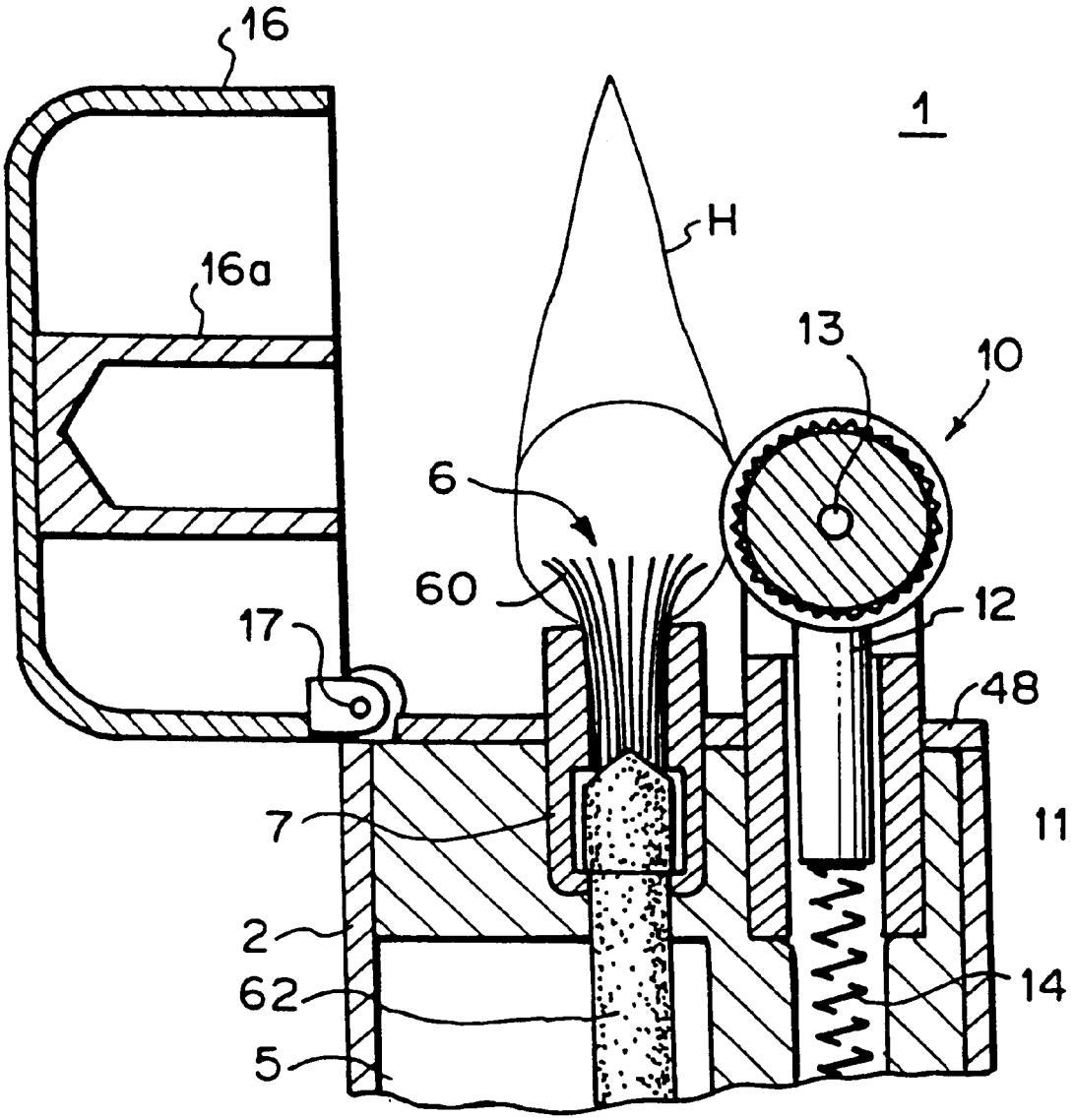
FIG. 8 is a schematic sectional view showing how flame shape changes in a lighter that is a comparative example in test 1.

In the comparison lighter 1, as the number of uses increased, the tip of the flame-producing portion 60 of the wick 6 frayed as shown in FIG. 8, the diameter of the glass fibers of the flame-producing portion 60 tip spread to 6 mm (initial diameter: 3 mm), the flame width spread accordingly to 12 mm (at a position 3 mm from the lower end of the flame) against a flame H shape of a flame length of 30 mm, a portion of the flame H touched the rotating striker wheel 13 and this portion of the rotating striker wheel 13 was heated and increased in temperature.

On the other hand, in the lighter according to the invention, as shown in FIG. 1, even as the number of uses increased, no change was observed in the tip shape of the flame-producing section 61 of the wick 6 or the shape of the flame H, and the flame did not touch the rotating striker wheel 13.

Embodiments in which the shape of the wick holder for retaining the wick is modified will be shown next.

<Seventh Embodiment>

Figure 9:
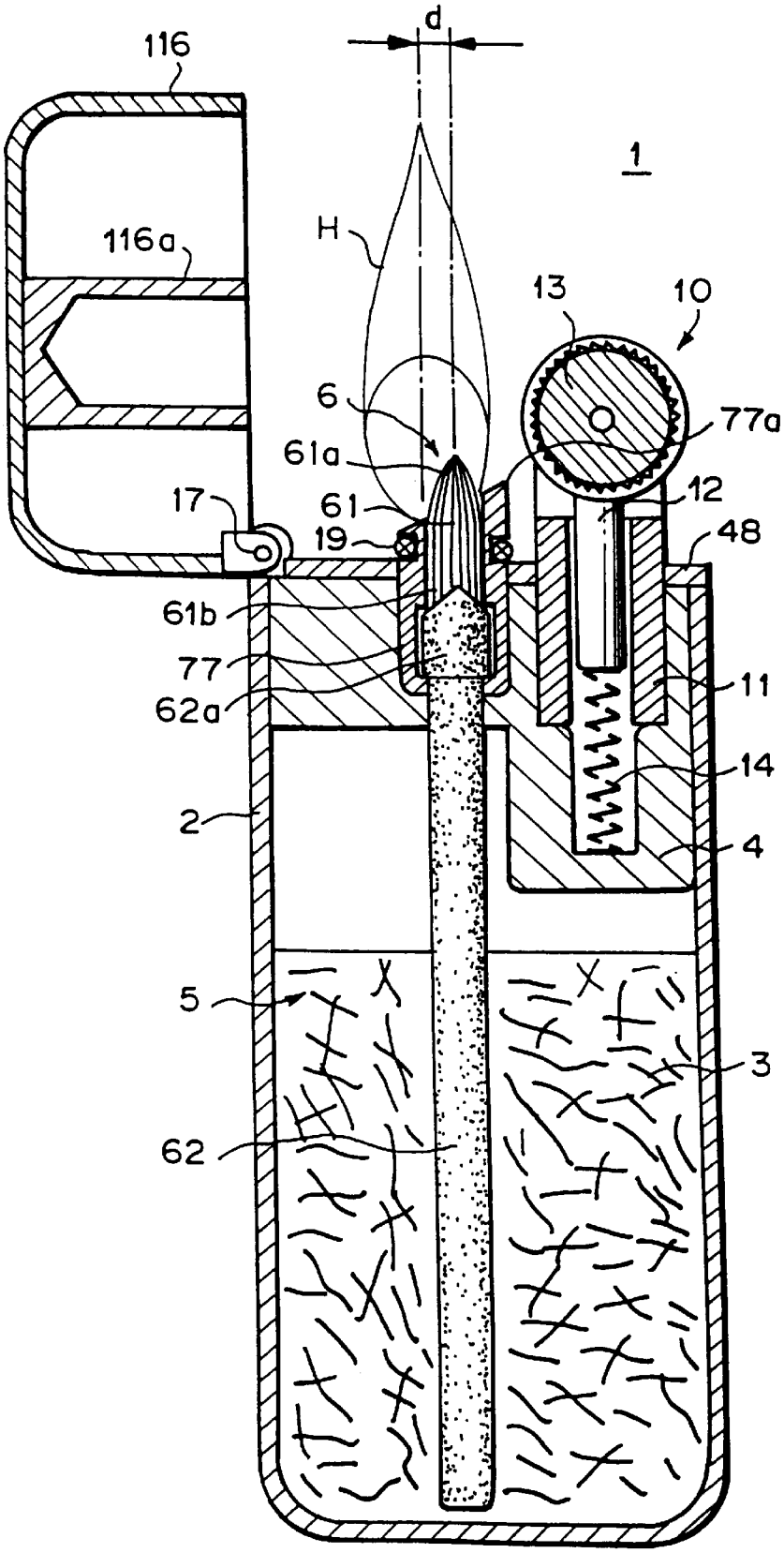
FIG. 9 is a schematic sectional view of a lighter as an example of a liquid fuel burner that is a seventh embodiment of the invention.

FIG. 9 shows the general sectional structure of a lighter as an example of a liquid fuel burner.

The basic structure of the lighter 1 is as set out above, the wick 6 being installed as fixed by a wick holder 77 to pass vertically through the top cover 4 into the fuel tank 2. The wick 6 is formed separately of different materials at an upper flame-producing section 61 and a lower draw-up section 62 and the two are joined by the cylindrical wick holder 77, which is made of metal and formed to have an inclined tip portion, with the lower end portion of the flame-producing section 61 and the upper end portion of the draw-up section 62 in a contacted state.

The lower end portion of the draw-up section 62 of the wick 6 contacts the fiber material 3 in the tank 2 and draws up the liquid fuel impregnated in the fiber material 3 utilizing capillarity. The flame-producing section 61 of the wick 6 is lit to burn and generate a flame H.

The flame-producing section 61 is made from glass fibers by, as in FIG. 1 for example, bundling glass fiber filaments and fusion-bonding the tip portion 61*a* to form it into a pointed shape like the tip of a writing brush. The draw-up section 62, formed as a rod having a large-diameter head portion 62*a* by molding and sintering polyethylene powder, has its head portion 62*a* inserted into the lower portion of the wick holder 77 and contacted with the base 61*b* of the flame-producing section 61 and the lower end portion of the wick holder 77 is caulked in this state, whereby the flame-producing section 61 and the draw-up section 62 are integrally joined to constitute the wick 6.

A closure cap 116 for evaporation prevention is provided to openably/closably cover the flame-producing section 61 of the wick 6 together with projecting portion of the wick holder 77. This closure cap 116 is rotatably pivoted by a pin 17 at one end portion of the upper surface of the top cover 4 of the tank 2. At the inner surface of the closure cap 116 is provided an inner cover 116*a* for enclosing the outer periphery of the wick holder 77 of the wick 6 and covering/sealing the wick 6. An O-ring 19 is horizontally attached to the outer peripheral root portion of the wick holder 77 and the inner peripheral surface of the inner cover 116*a* of the closure cap 16 presses thereon to enhance the sealing property. A face plate 48 is provided on the upper surface of the top cover 4.

In the lighter 1 of the foregoing structure, the tip portion 77*a* of the wick holder 77, which surrounds and holds the outer periphery of the flame-producing section 61 of the wick 6, is formed slantedly to differ in height in the peripheral direction. The wick holder 77 is disposed so that the portion of the inclined tip portion 77*a* having the highest height is located near the rotating striker wheel 13, that is the igniter 10, and is interposed between the flame H and the rotating striker wheel 13.

The dimensions of the wick holder 77 are, for example, outer diameter of 4 mm, inner diameter of 3 mm and inclination angle of the tip portion 77*a* of 45°. The height of the wick 6 flame-producing section 61 projecting from this wick holder 77 is 3 mm at the most exposed portion. The distance between the center of the wick 6 and the center of the rotating striker wheel 13 is set at 8 mm.

In this embodiment, under conditions adjusted to make the flame length 30 mm, the center of the flame H is offset relative to the center of the wick 6 by d=2 mm to the side opposite from the rotating striker wheel 13, the flame width is 8 mm and the position of greatest flame width is 3 mm from the lower end of the flame. With this flame shape, the flame H does not touch the rotating striker wheel 13 and good burning and use conditions can be obtained even if the distance between the center of the wick 6 and the center of the rotating striker wheel 13 is set to a narrow 8 mm as stated above.

Figure 16:
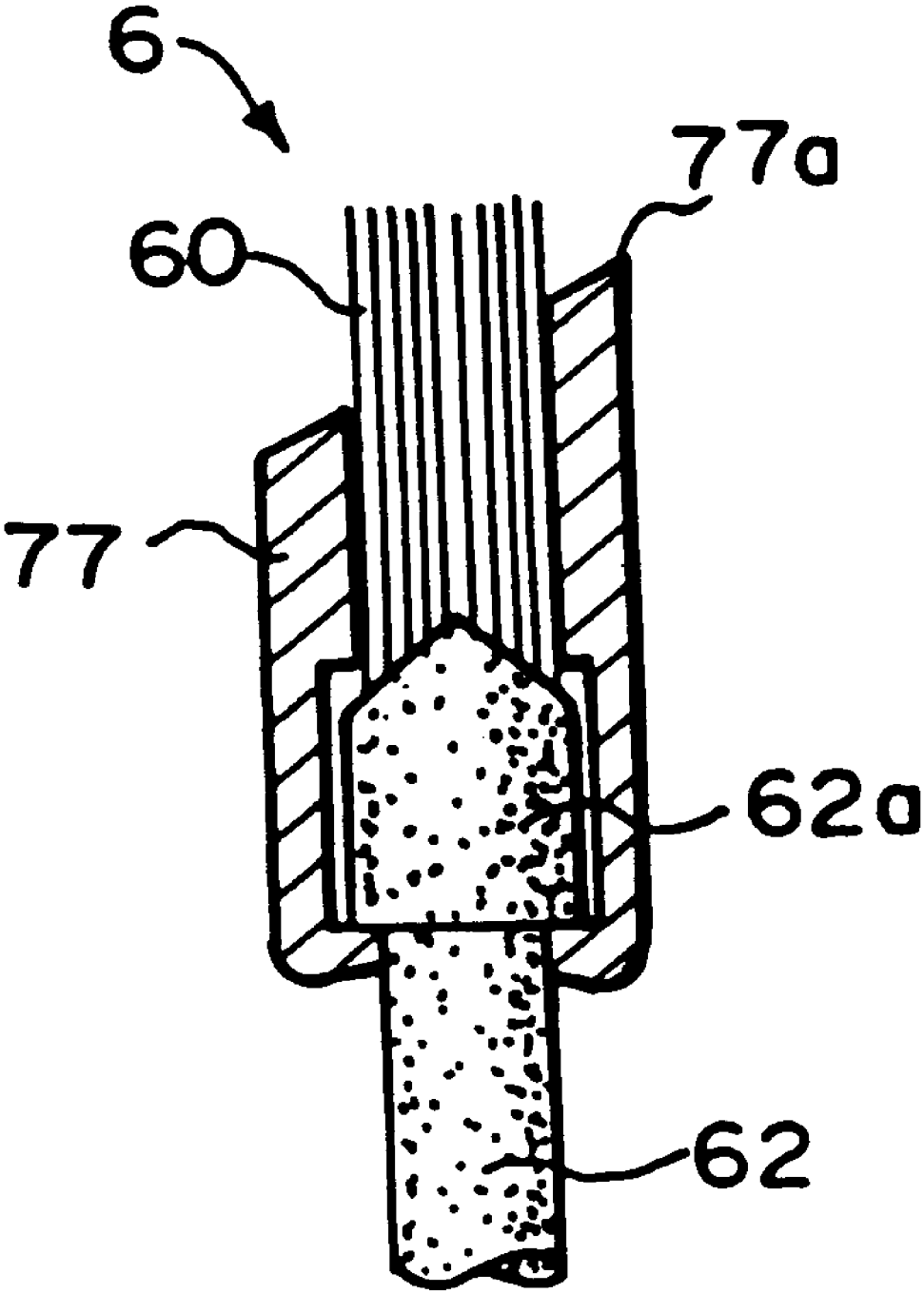
FIG. 16 is a schematic sectional view showing another example of the wick of the seventh embodiment.

Although the tip portion 61*a* of the glass fiber flame-producing section 61 of the wick 6 is fusion-bonded in this seventh embodiment, it can instead be left as an unbonded flame-producing portion 60 as shown in FIG. 16. In this case, the tip end portion of the flame-producing portion 60 is preferably structured so as not to contact/interfere with the open/close path of the closure cap 116.

<Eighth Embodiment>

Figure 10:
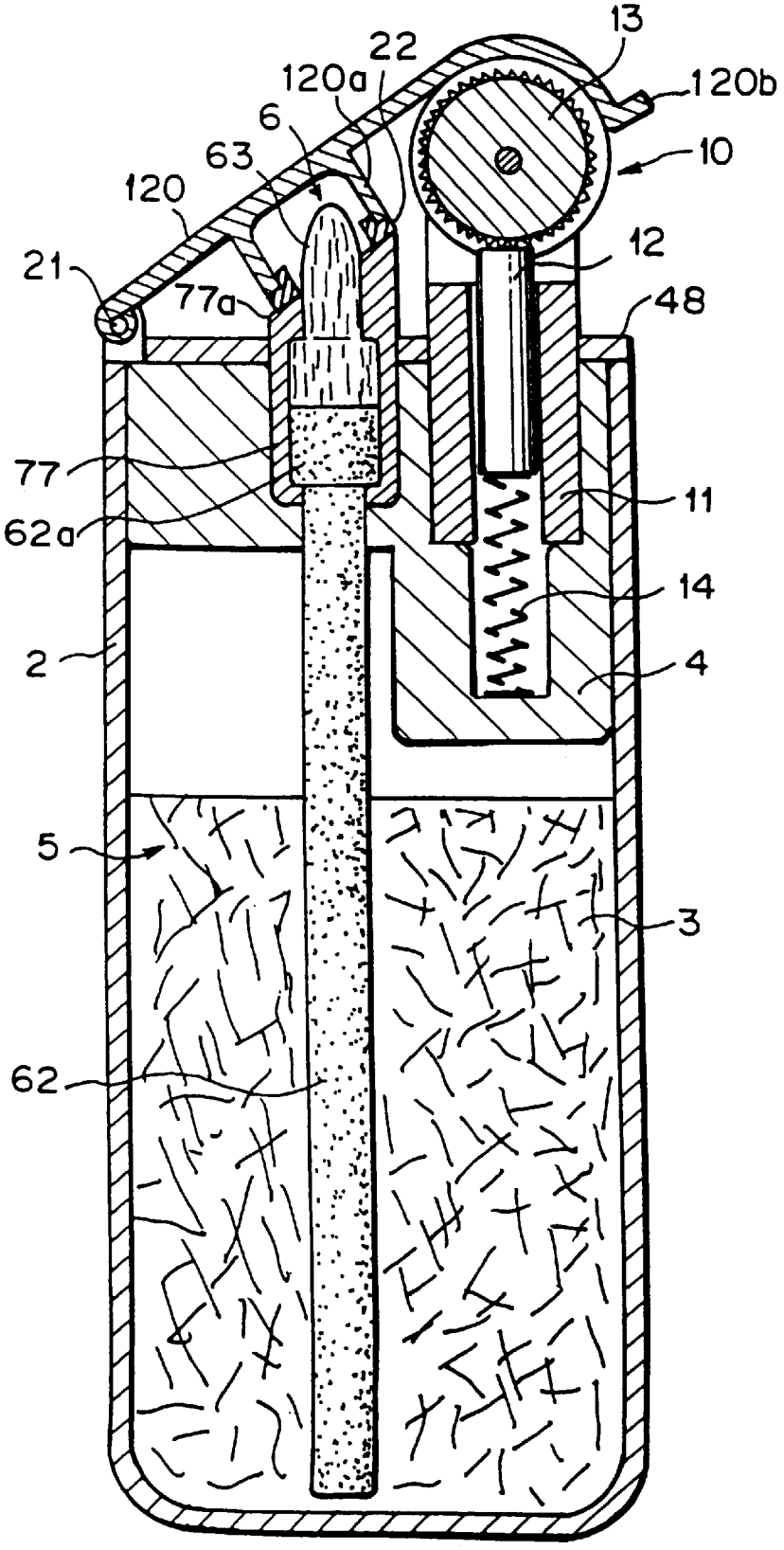
FIG. 10 is a schematic sectional view of a lighter that is an eighth embodiment of the invention.

As shown in FIG. 10, the lighter 1 of this embodiment has the same type of wick holder 77 as in the preceding embodiment but the closure cap 120 is of a different type.

In the closure cap 120 of this embodiment, one end portion of a main body formed in the shape of a flat plate is rotatably pivoted on the top cover 4 of the tank 2 by a pin 21, the tip portion on the opposite side from the pivot portion is provided to extend along and engage with the rotating striker wheel 13 of the igniter 10, and a projection 120*b* for opening operation is provided on the tip portion, the closure condition being in an inclined state.

A cup-shaped closure portion 120*a* is fixed to the inner surface of the main body of the closure cap 120 to face the inclined shape of the inclined tip portion 77*a* of the wick holder 77. This closure portion 120*a* is constituted so that when closed its inclination angle is the same as the inclination angle of the wick holder 77. A seal member 22 is attached to the tip edge portion of the closure portion 120*a* and this seal member 22 is structured to press onto the inclined tip portion 77*a* of the wick holder 77.

The flame-producing section 63 of the wick 6 in this embodiment is formed in round rod-like shape not of glass fibers but of a porous glass sintered body or porous ceramic sintered body, contains continuous bubbles (capillary passages) inside, and is formed thin at the tip portion. Its upper portion is mounted to protrude from the tip surface 77*a* of the wick holder 77 by a prescribed amount (3 mm at the most exposed portion). The setting of this protrusion amount, the diameter and the like determine the size of the flame. For instance, it is constituted to have an outer diameter of 3.0 mm and a length of 10 mm.

On the other hand, the draw-up section 62 whose tip portion abuts on the lower end of the flame-producing section 63 is again a porous material made of a sintered body of polyethylene powder and formed into round rod-like shape. Other aspects are formed like those of the seventh embodiment.

The closure cap 120 of this embodiment is simplified in structure and since the closure portion 120*a* achieves sealing by pressing onto to the inclined tip portion 77*a* via the seal member 22, without fitting over the outer periphery of the wick holder 77, the distance between the support position by the pin 21 of the closure cap 120 and the center of the wick 6 can be shortened and the distance between the wick holder 77, i.e., the wick 6, and the striker wheel 13 of the igniter 10 can be further shortened to make the lighter 1 compact.

<Ninth Embodiment>

Figure 11:
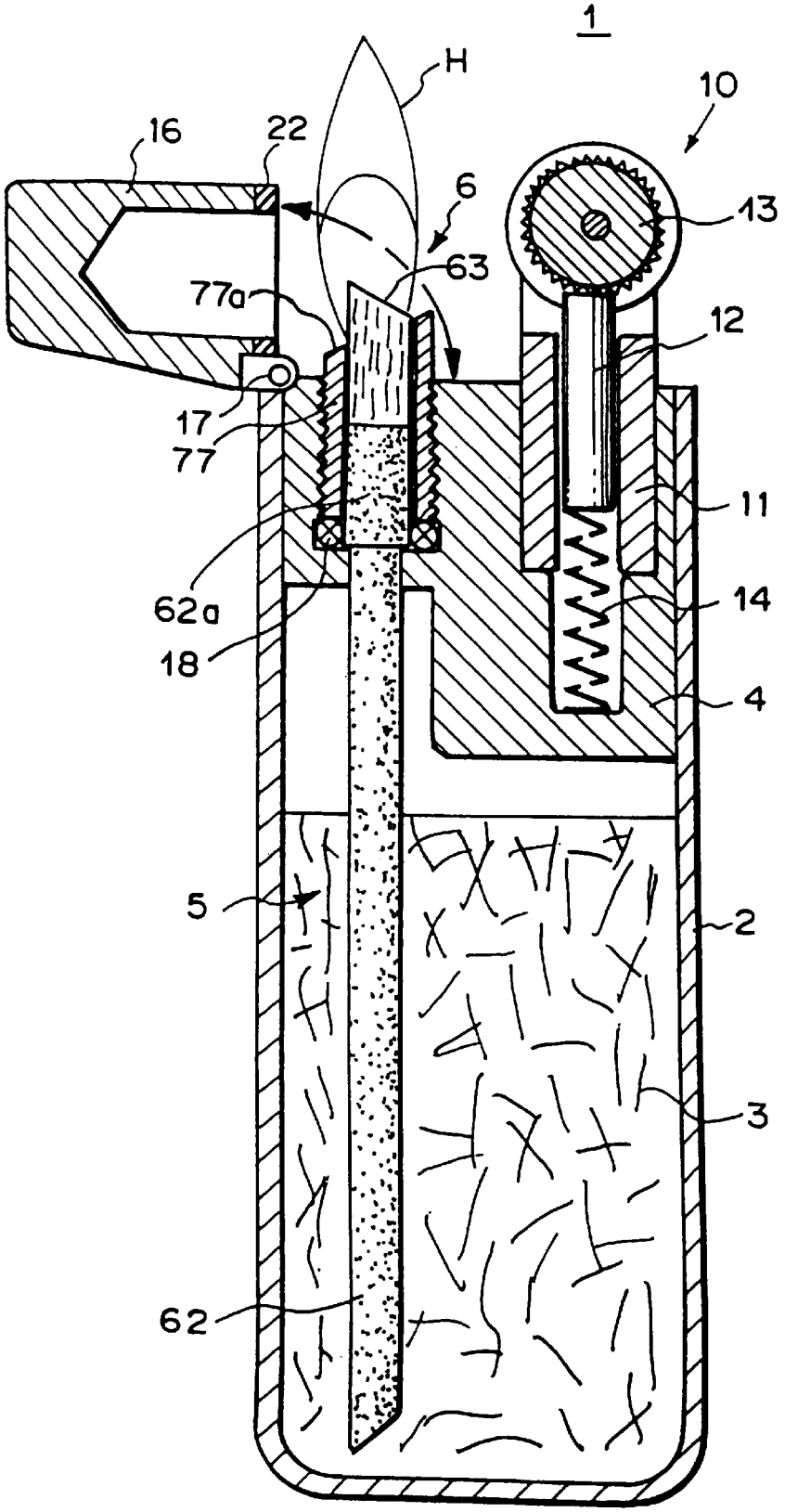
FIG. 11 is a schematic sectional view of a lighter that is a ninth embodiment of the invention.

As shown in FIG. 11, the shape of the tip portion of the wick 6 of the lighter 1 of this embodiment is different.

The flame-producing section 63 of the wick 6 is formed in a rod-like shape of a porous ceramic sintered body and its tip portion is removed slantedly at the side portion opposite from the support pin 17 of the closure cap 16, whereby it is structured to avoid interference with the opening/closing rotation of the closure cap 16.

The closure cap 16 is structured to openably/closably cover the flame-producing section 63 of the wick 6 together with the projecting portion of the wick holder 77 but not to cover the top of the igniter 10. A seal member 22 is attached to the tip portion of the sealing portion of the closure cap 16 and this seal member 22 is constituted to achieve sealing by pressing onto the top cover 4 around the wick holder 77 at closing operation of the closure cap 16.

<Tenth Embodiment>

Figure 12:
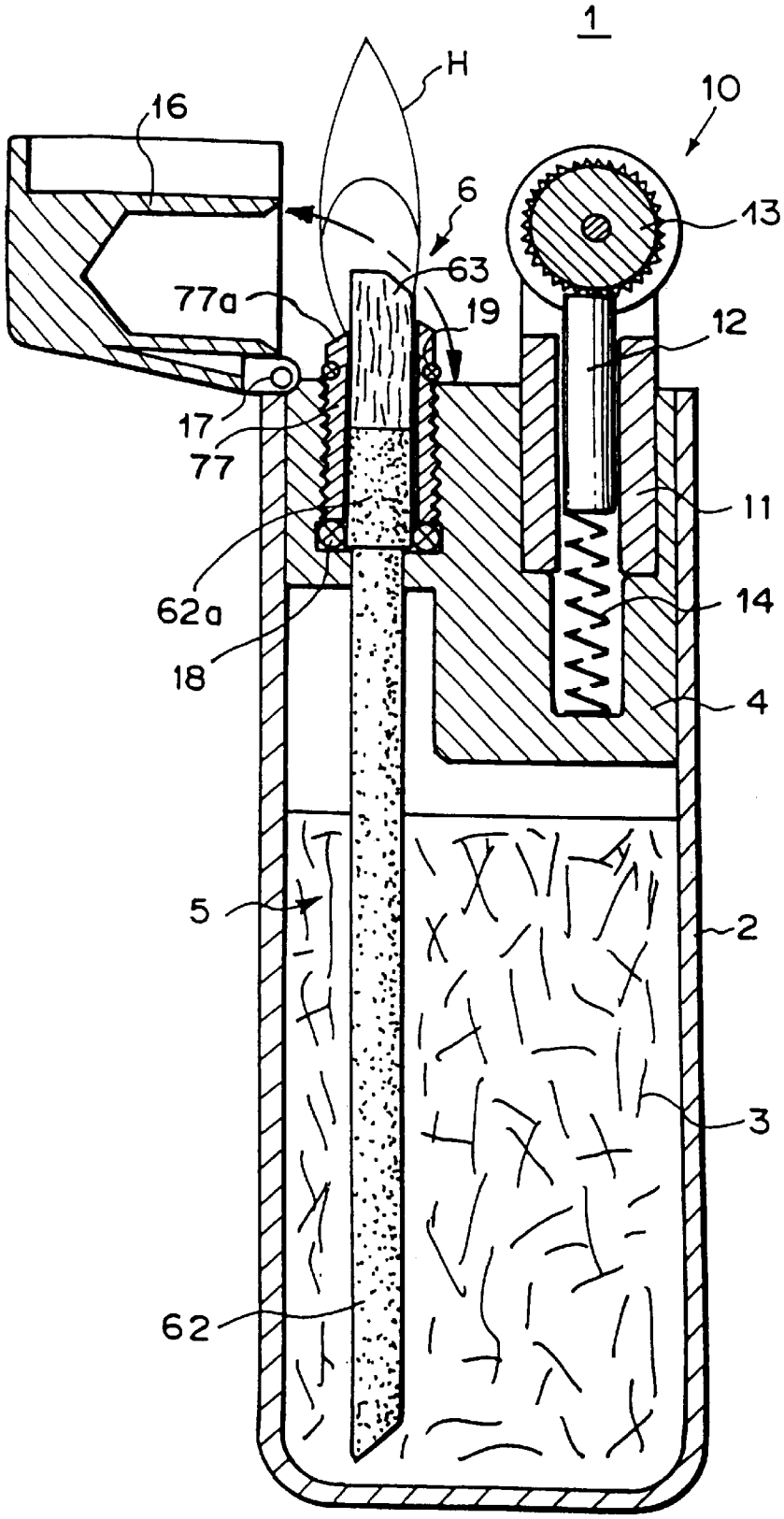
FIG. 12 is a schematic sectional view of a lighter that is a tenth embodiment of the invention.

As shown in FIG. 12, the shapes of the tip portion of the wick 6 and the wick holder 77 of the lighter 1 of this embodiment are different.

The flame-producing section 63 of the wick 6 is formed in a rod-like shape of a porous ceramic sintered body and the corner of its tip portion is removed slantedly at the side portion opposite from the support pin 17 of the closure cap 16 and, further, the tip portion 77*a* of the wick holder 77 is also removed of part of its highest portion, whereby they are structured to avoid interference with the opening/closing rotation of the closure cap 16. Other aspects are the same as in the ninth embodiment.

<Eleventh Embodiment>

Figure 13:
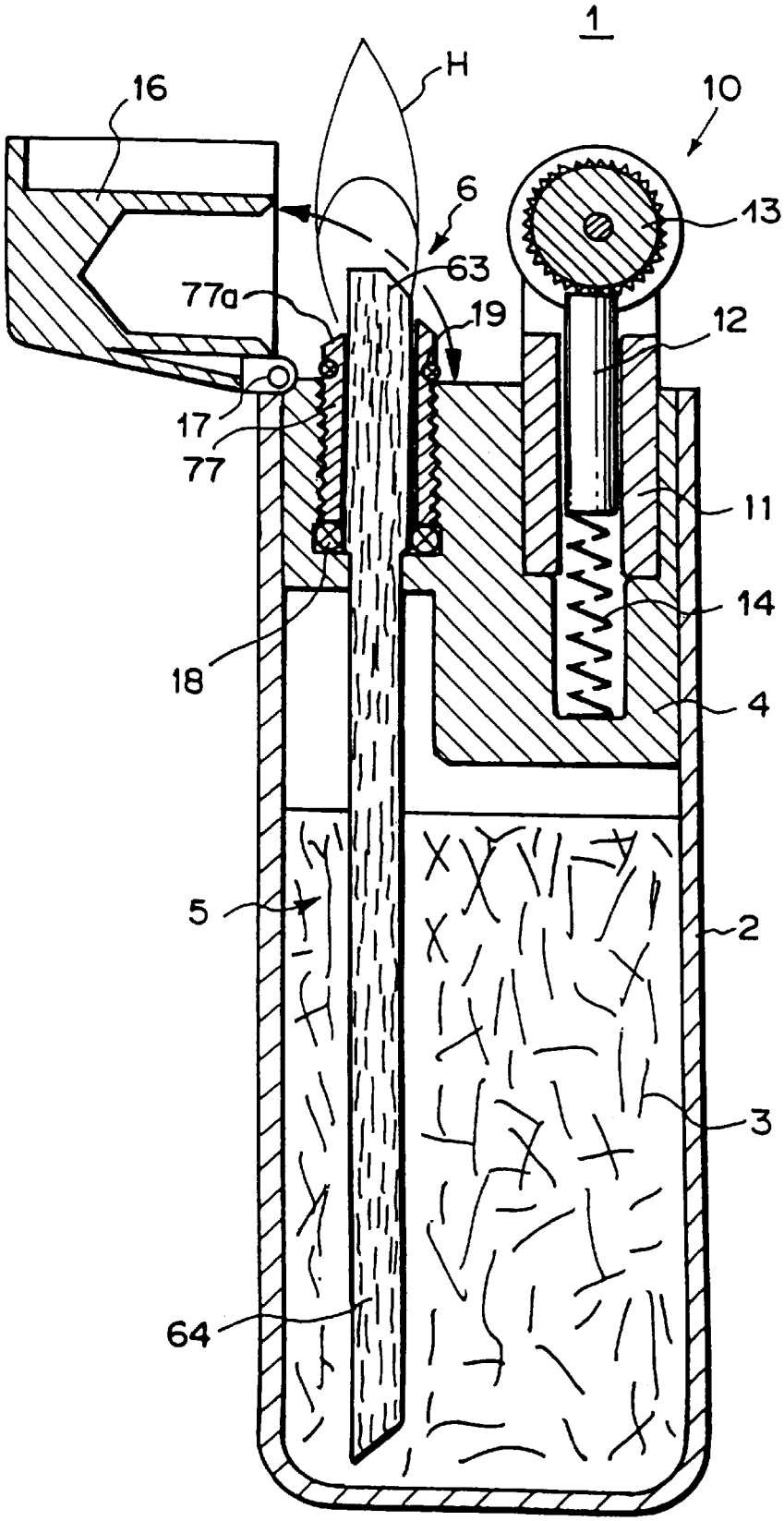
FIG. 13 is a schematic sectional view of a lighter that is an eleventh embodiment of the invention.
Figure 14A:
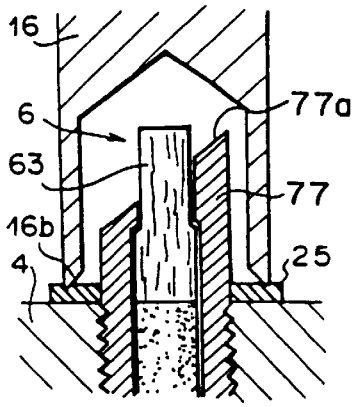
FIGS. 14(A)–14(F) show sectional views of the essential portions of examples of structures for wick sealing by the closure cap according a twelfth embodiment of the invention.
Figure 14B:
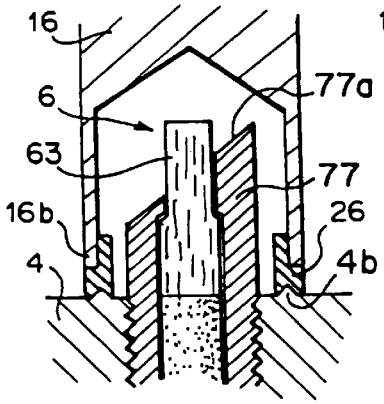
Figure 14C:
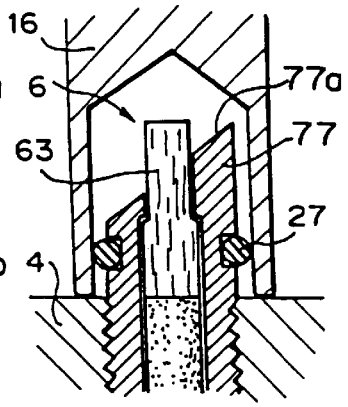
Figure 14D:
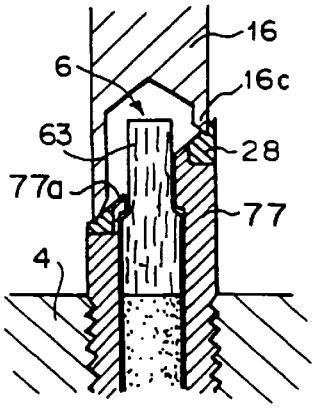
Figure 14E:
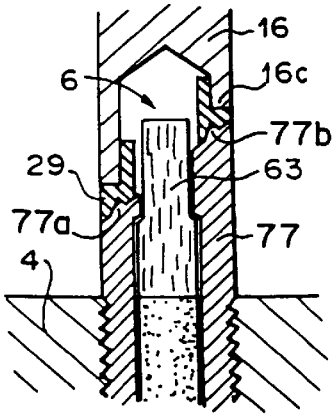
Figure 14F:
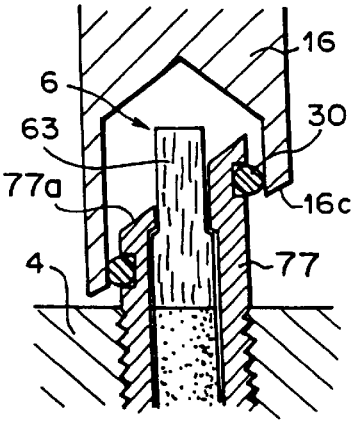
Figure 15A:
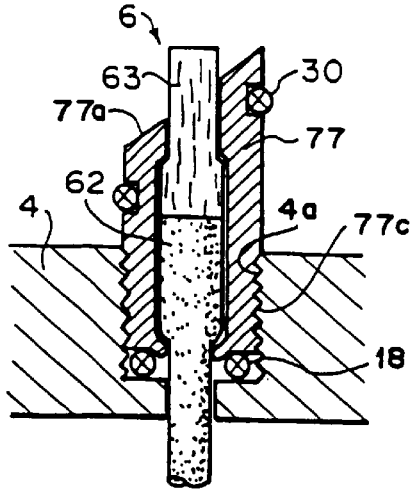
FIGS. 15(A)–15(F) show sectional views of the essential portions of examples of wick holding structures and structures for attachment of the wick to a top cover according a thirteenth embodiment of the invention.
Figure 15B:
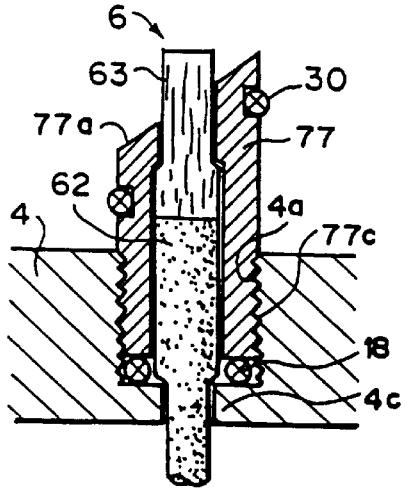
Figure 15C:
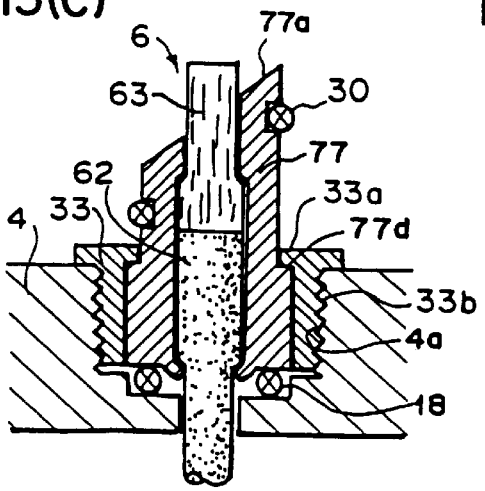
Figure 15D:
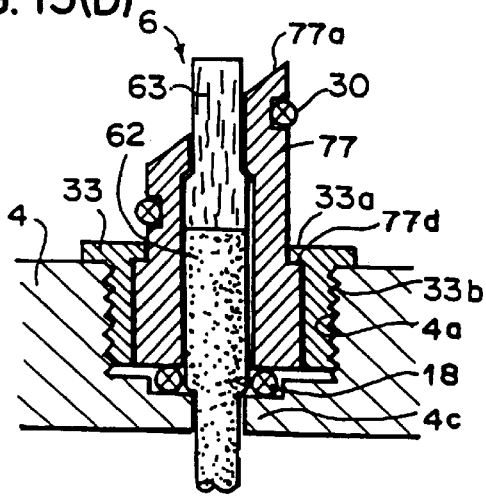
Figure 15E:
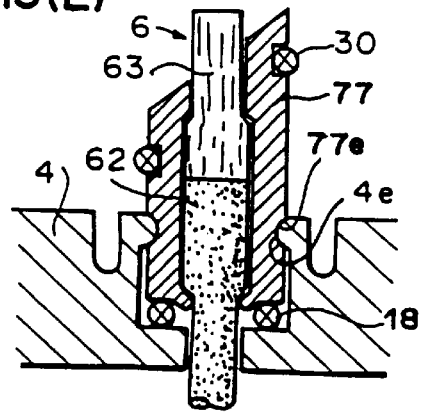
Figure 15F:
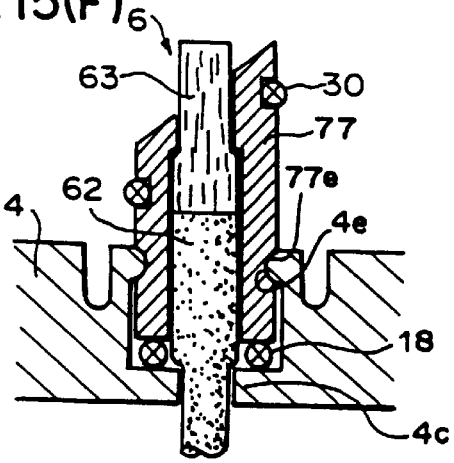

As shown in FIG. 13, the wick 6 of the lighter 1 of this embodiment is integrally formed throughout of the same material. Other aspects are structured like those of the tenth embodiment.

In other words, the wick 6 has its flame-producing section 63 and draw-up section 64 formed integrally of a porous ceramic sintered body, is retained by the wick holder 77, and has the same shape as the one in FIG. 12.

<Twelfth Embodiment>

FIGS. 14(A) to (F) show various examples of the seal structure of the flame-producing section of the wick 6 by the closure cap 16 in a lighters equipped with a wick holder 77 with an inclined tip.

(A) is a structure wherein a seal member 25 is disposed on the upper surface of the top cover 4 around the wick holder 77 and seals by pressing the tip portion 16*b* of the closure cap 16 onto the seal member 25.

(B) is a structure wherein an annular projection 4*b* is provided on the upper surface of the top cover 4 around the wick holder 77 while a ring-like seal member 26 is attached to the sealing tip portion 16*b* of the closure cap 16, sealing being obtained by pressing the seal member 26 onto the annular projection 4*b*.

(C) is a structure wherein an O-ring 27 if fitted horizontally around the wick holder 77, sealing being obtained by abutting the inner surface of the closure cap 16 onto the O-ring 27.

(D) is a structure wherein a seal member 28 is provided slantedly on the inclined tip portion 77*a* of the wick holder 77, sealing being obtained by pressing the inclined lower end portion 16*c* of the closure cap 16 onto the annular seal member 28.

(E) is a structure wherein an annular projection 77*b* is provided on the inclined tip portion 77*a* of the wick holder 77 and a seal member 29 is attached to the inclined lower end portion 16*c* of the closure cap 16, sealing being obtained by pressing the seal member 29 onto the annular projection 77*b*.

(F) is a structure wherein an O-ring 30 is fitted on the outer periphery of the wick holder 77 slantedly in parallel with the inclined tip portion 77*a*, sealing be obtained by pressing the inner surface of the inclined lower end portion 16*c* of the closure cap 16 onto the O-ring 30.

<Thirteenth Embodiment>

FIGS. 15(A) to (F) show various examples of the structure for joining or fastening the flame-producing section and the draw-up section of the wick and of the structure for attaching the wick to the fuel tank together with the wick holder.

(A) is a structure wherein the flame-producing section 63 and the head of the draw-up section 62 of the wick 6 are inserted into the wick holder 77 and then joined by caulking the lower end portion (or upper end portion) of the wick holder 77, and the wick holder 77 is attached by screwing a fastening thread 77*c* on the outer periphery thereof into the threaded hole 4*a* formed in the top cover 4 to sandwich the O-ring 18 at the bottom.

(B) is a structure wherein the lower end portion of the wick holder 77 is not caulked, the lower end of the head of the draw-up section 62 is held by a retaining portion 4*c* of the top cover 4, and the wick holder 77 is attached to the top cover 4 by fastening it in the threaded hole 4*a* from above to sandwich the O-ring 18 while joining the flame-producing section 63 to the draw-up section 62.

(C) is a structure wherein the wick holder 77 is not formed with a fastening thread but is attached via an anchor ring 33 by engaging an upper engaging portion 33*a* of the anchor ring 33 with a step portion 77*d* of the wick holder 77 and screwing a fastening thread 33*b* on the outer periphery of the anchor ring 33 into the threaded hole 4*a* of the top cover 4, the fixing of the wick 6 with respect to the wick holder 77 being the same as in (A).

(D) combines a structure for attaching the wick holder 77 to the top cover 4 like that of (C) and a structure for fixing wick 6 like that of (B).

(E) is a structure wherein a U-groove 77*e* is formed in the outer periphery of the wick holder 77, an engaging projection 4*e* imparted with elasticity is provided on the top cover 4, and attachment is achieved by forcing the bottom portion of the wick holder 77 into the top cover 4 to engage the tip of the engaging projection 4*e* with the U-groove 77*e*, the retention of the wick 6 being the same as in (A) above.

(F) combines a structure for attaching the wick holder 77 to the top cover 4 like that of (E) and a structure for fixing the wick 6 like that of (B).

<Test 2>

Next, there will be indicated the results when a lighter was used like that of the seventh embodiment (FIG. 9) except that the flame-producing section of the wick incorporated therein was the one shown in FIG. 16 whose tip portion is not fusion-bonded, the wick was lit and allowed to burn, and the change in the shape of the flame when a metal plate simulating an igniter was brought near the flame was obtained by measuring the distance between the flame and the metal plate. The shape of the metal plate was: height of 8 mm from the lower end of the flame and width of 6 mm, 8 mm or 10 mm. Each metal plate simulated an igniter (striker wheel) and the metal plate changed the flame shape by changing the flow of air relative to the flame.

Figures 17A, 17B:
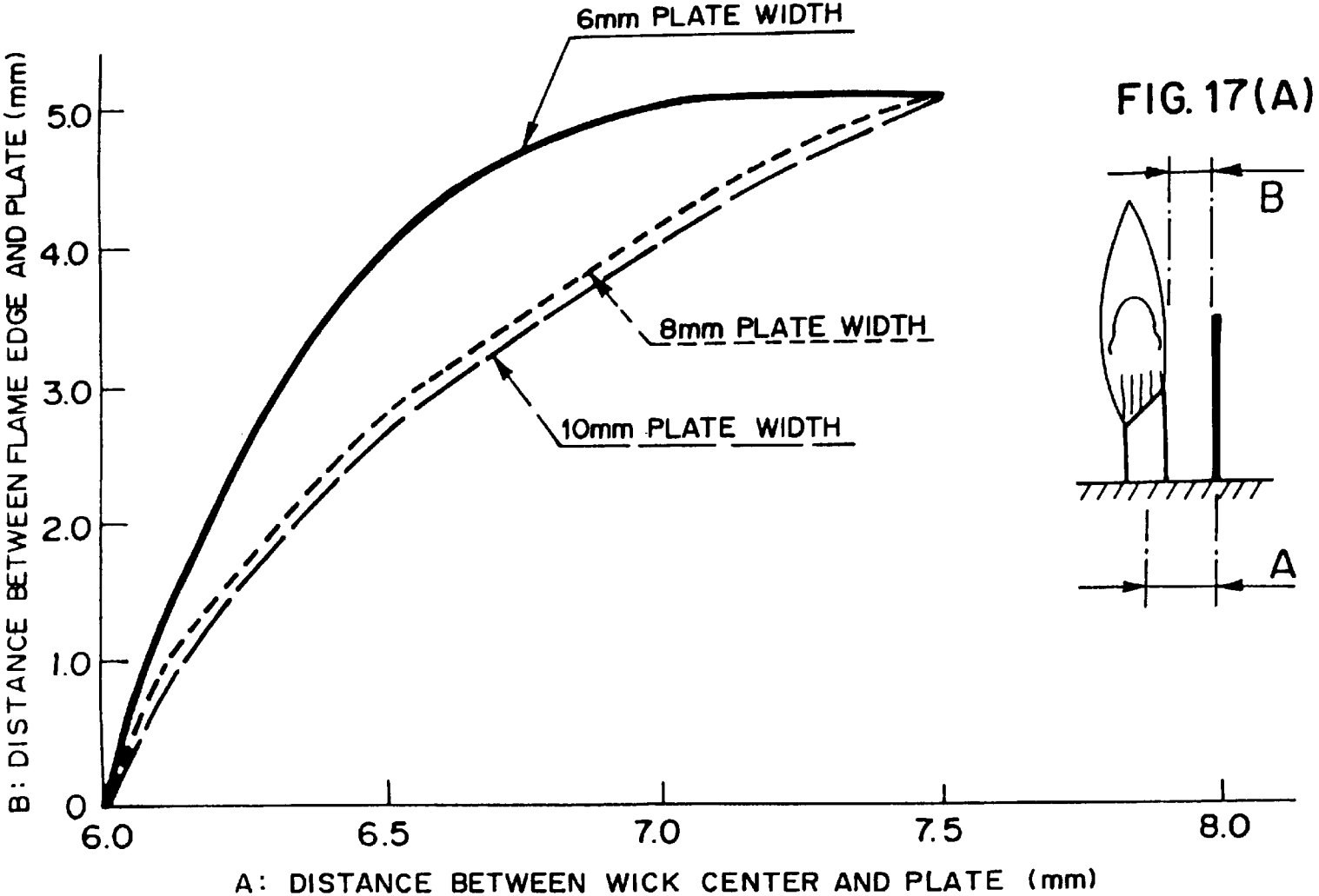
FIG. 17(A) shows a metal plate near a flame produced by a lighter according to the invention.
FIG. 17(B) is graph showing the results of a test 2 when the change in flame shape caused by placing a metal plate near the wick of an invention lighter was measured.

As a comparative example, the state was measured when identical metal plates were brought near the flame of a lighter wherein the tip portion of the wick holder was of constant in height in the peripheral direction and had a horizontally flat shape, while being identical in other aspects. FIG. 17 shows the measurement results for the invention product and FIG. 18 the measurement results for the comparative example.

Figures 18A, 18B:
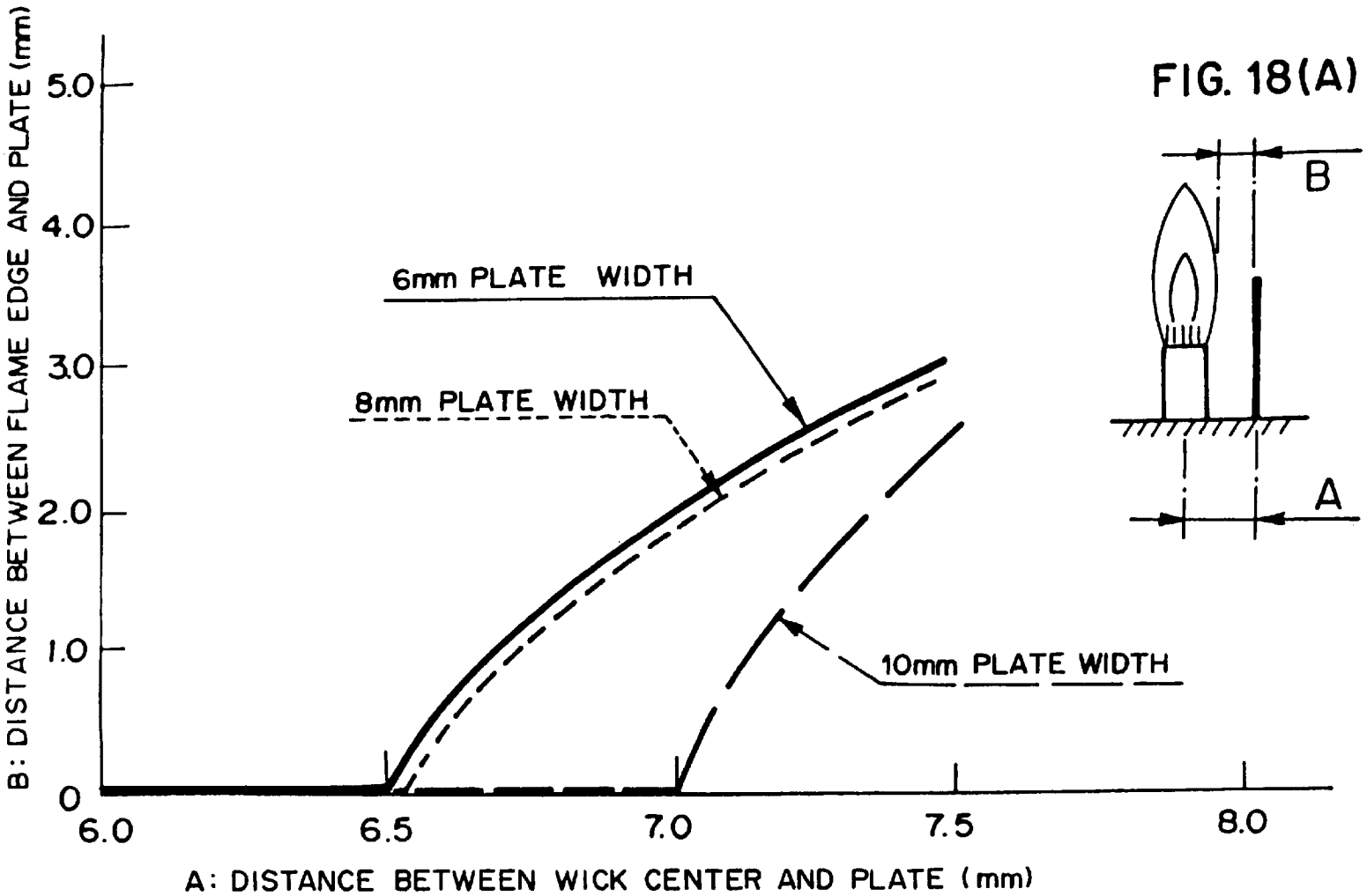
FIG. 18(B) a graph showing other results of the test 2 when the change in flame shape caused by placing a metal plate near the wick of comparative lighter was measured.

In the case of FIG. 18 for the comparative example in which the tip of the wick holder was flat, when the distance A between the metal plate and the center of the wick was made 7 mm, the distance B between the flame and the metal plate was 2 mm at the plate widths of 6 mm and 8 mm and made contact with the flame in the case of the metal plate of 10 mm plate width. When the distance A between the metal plate and the center of the flame was made 6.5 mm, the metal plates of all plate widths touched the flame.

On the other hand, in the case of FIG. 17 according to the invention, in which the tip portion of the wick holder 77 was inclined, when the distance A between the center of the wick and the metal plate was made 7 mm, the distance B between the flame side surface and the metal plate was 4 mm for the metal plates of 8 mm and 10 mm plate width and was 5 mm for the metal plate of 6 mm plate width, which values are greater than in the comparative example.

The foregoing results mean that in configuring lighters, if the distance between the wick 6 and the igniter 10 is fixed, distance can be secured between the flame and the igniter by inclining the tip of the wick holder 77, whereby temperature rise of the igniter can be prevented, the igniter can be brought closer to the wick, the lighter can be made smaller, and the reliability of its igniting performance can be enhanced.

We claim:

1. In a liquid fuel burner comprising a wick for drawing up by the capillarity of a draw-up section liquid fuel to be burned at a flame-producing section, an igniter for igniting the flame-producing section of the wick and a closure cap for preventing evaporation capable of sealing the flame-producing section of the wick openably and closably, a wick of the liquid fuel burner characterized in that the flame-producing section of the wick is constituted in a shape to have a tapered tip portion.

2. A liquid fuel burner according to claim 1, characterized in that the closure cap is constituted to open and close about a pivot at one end portion thereof and the tip portion of the flame-producing section on a side opposite from the pivot of the closure cap is removed.

3. A liquid fuel burner according to claim 1, characterized in that in the wick a tip portion of the flame-producing section made of glass fibers is fusion-bonded into a pointed shape like the tip of a writing brush.

4. A liquid fuel burner according to claim 3, characterized in that the wick is shaped by bundling glass fibers, heating and fusing a portion thereof with a high-temperature burner and drawing out and separating the fused portion.

5. A liquid fuel burner according to claim 1, characterized in that the wick comprises a flame-producing section composed of a porous glass material having continuous bubbles or a sintered porous ceramic material and constituted in a tapered shape.

6. A liquid fuel burner according to claim 1, characterized in that the wick is formed of different materials at the draw-up section and the flame-producing section.

7. A liquid fuel burner according to claim 1, characterized in that the draw-up section and the flame-producing section of the wick are formed integrally of the same material.

8. In a liquid fuel burner comprising a wick for drawing up by the capillarity of a draw-up section liquid fuel to be burned at a flame-producing section, an igniter for igniting the flame-producing section of the wick and a closure cap for preventing evaporation capable of sealing the flame-producing section of the wick openably and closably, the liquid fuel burner characterized in that a wick holder for holding the wick is provided around the flame-producing section at a tip of the wick and a tip portion of the wick holder is formed to differ in height in a circumferential direction, a tip portion of high height being disposed to be interposed between the flame-producing section of the wick and the igniter.

9. A liquid fuel burner according to claim 8, characterized in that the closure cap is constituted to open and close about a pivot at one end portion thereof and an edge portion of a sealing portion thereof for sealing the flame-producing section of the wick is formed to differ in height in a circumferential direction complementarily to the shape of the tip portion of the wick holder.

10. A liquid fuel burner according to claim 8, characterized in that in the wick a tip portion of the flame-producing section on the side opposite from the pivot of the closure cap is removed.

11. A liquid fuel burner according to claim 8, characterized in that in the wick a tip portion of the flame-producing section made of glass fibers is fusion-bonded into a pointed shape like the tip of a writing brush.

12. A liquid fuel burner according to claim 8, characterized in that the wick is composed of a porous glass material having continuous bubbles or a sintered porous ceramic material.

13. A wick of a liquid fuel burner according to claim 8, characterized in that the wick is formed of different materials at the draw-up section and the flame-producing section.

14. A wick of a liquid fuel burner according to claim 8, characterized in that the draw-up section and the flame-producing section of the wick are formed integrally of the same material.

* * * * *

UNITED STATES PATENT AND TRADEMARK OFFICE

CERTIFICATE OF CORRECTION

PATENT NO. : 6,102,688
DATED : August 15, 2000
INVENTOR(S) : H. Mifune et al.

It is certified that error appears in the above-identified patent and that said Letters Patent is hereby corrected as shown below:

Title page,
Item 54, "COMBUSTION APPARATUS FOR LIQUID FUEL AND COMBUSTION WICK" should read -- LIQUID FUEL BURNER AND WICK THEREOF --.

Item 86, "§371 Date; §102(e) Date: "Feb. 16, 1999"" (both occurrences) should read -- Oct. 19, 1998 --.

Specification,
Column 3,
Line 32, "preclude" should read -- precluded --.

Colulmn 4,
Line 56, "Figs. 7 (A)- 7(C) views" should read -- Figs. 7(A) -7(C) show views --.

Column 5,
Line 27, "of comparative" should read -- of a comparative --.

Column 7,
Line 39, "more over" should read -- moreover -- and "sealine" should read -- since the --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*